US007987796B2

(12) United States Patent
Nordstrom et al.

(10) Patent No.: US 7,987,796 B2
(45) Date of Patent: Aug. 2, 2011

(54) LOADING PALLET

(75) Inventors: Claes Nordstrom, Lund (SE); Lennart Nilsson, Bjarred (SE)

(73) Assignee: Crossborder Technologies AB, Bjarred (SE)

( * ) Notice: Subject to any disclaimer, the term of this patent is extended or adjusted under 35 U.S.C. 154(b) by 609 days.

(21) Appl. No.: 11/995,258

(22) PCT Filed: Jul. 10, 2006

(86) PCT No.: PCT/SE2006/000859
§ 371 (c)(1),
(2), (4) Date: Jul. 15, 2008

(87) PCT Pub. No.: WO2007/008153
PCT Pub. Date: Jan. 18, 2007

(65) Prior Publication Data

US 2009/0000524 A1 Jan. 1, 2009

(30) Foreign Application Priority Data

Jul. 11, 2005 (SE) ..... 0501632

(51) Int. Cl.
*B65D 19/38* (2006.01)

(52) U.S. Cl. ..... 108/53.3; 108/55.1; 108/57.32; 206/600

(58) Field of Classification Search ..... 108/53.1, 108/53.3, 57.17–57.18, 57.21–57.22, 57.24, 108/57.29, 57.32, 51.1, 56.1, 56.3, 55.1; 206/386, 600
See application file for complete search history.

(56) References Cited

U.S. PATENT DOCUMENTS

| | | | | |
|---|---|---|---|---|
| 2,447,542 | A | 8/1948 | Seward | |
| 2,692,107 | A * | 10/1954 | De Ridder et al. | 108/57.17 |
| 3,137,250 | A | 6/1964 | Hutchinson | |
| 3,172,374 | A * | 3/1965 | Allen | 108/57.29 |
| 3,227,108 | A * | 1/1966 | Greaves | 108/53.3 |
| 3,701,326 | A * | 10/1972 | Herman | 108/53.3 |
| 3,756,167 | A * | 9/1973 | Wilson | 108/57.14 |
| 3,759,193 | A | 9/1973 | Branch | |
| 4,240,360 | A * | 12/1980 | Sanders et al. | 108/53.3 |
| 4,382,414 | A * | 5/1983 | Svirklys | 108/56.1 |
| 5,036,979 | A | 8/1991 | Selz | |
| D335,743 | S * | 5/1993 | Nordstrom | D34/38 |

(Continued)

FOREIGN PATENT DOCUMENTS

| | | |
|---|---|---|
| DE | 24 42 322 A1 | 3/1976 |
| DE | 32 05 516 A1 | 8/1983 |
| DE | 20 2005 011 652 U1 | 11/2005 |
| EP | 0 571 429 B1 | 4/1996 |

(Continued)

*Primary Examiner* — Hanh V Tran
(74) *Attorney, Agent, or Firm* — Tarolli, Sundheim, Covell & Tummino LLP

(57) ABSTRACT

A loading pallet includes first bars (2) and second bars (3) arranged essentially parallel with each other, The first bars (2) are arranged essentially in a single plane (8) and the second bars (3) include upper parts (9) arranged essentially in the plane (8) and downwardly directed parts (10) directed downwards relative to the plane (8). Third bars (4) are arranged transverse to the first bars (2) and second bars (3), lie under the plane (8), and are connected to the first bars (2) and the upper parts (9) of the second bars (3). The loading pallet (1) can be stacked onto a corresponding loading pallet (1), whereby the third bars (4) can make contact with such bars (2) from the loading pallet (1) located below. The height (h5) of the third bars (4) is such that the height of the spaces between stacked loading pallets (1) is such that lifting structure (17) can be introduced into the spaces for lifting loading pallets (1).

61 Claims, 19 Drawing Sheets

U.S. PATENT DOCUMENTS

| | | | | |
|---|---|---|---|---|
| 5,320,048 | A * | 6/1994 | Feiner | 108/51.11 |
| 5,460,103 | A * | 10/1995 | Dunn et al. | 108/57.18 |
| 5,595,305 | A | 1/1997 | Hart | |
| 5,667,065 | A | 9/1997 | Fahrion | |
| 6,216,899 | B1 * | 4/2001 | Vicari | 220/1.5 |
| 6,463,863 | B1 * | 10/2002 | Ishikawa et al. | 108/53.1 |
| 6,669,089 | B2 * | 12/2003 | Cybulski et al. | 235/385 |

FOREIGN PATENT DOCUMENTS

| | | |
|---|---|---|
| FR | 2 351 016 | 12/1977 |
| GB | 817690 | 8/1959 |
| GB | 958500 | 5/1964 |
| GB | 1008928 | 11/1965 |
| SE | 434 251 | 7/1984 |
| SE | 450 245 | 6/1987 |

* cited by examiner

LOADING PALLET

FIELD OF THE INVENTION

The present invention concerns a loading pallet demonstrating metal bars.

BACKGROUND OF THE INVENTION

Loading pallets of metal parts are previously known from GB 1 008 928, U.S. Pat. No. 3,701,326 and EP 0 571 429. These known loading pallets, however, consist of complicated and heavy designs that are not easy to stack, or they are at least not easy to stack with the aid of forklifts.

SUMMARY OF THE INVENTION

The aim of the present invention has been to achieve a simple and stable loading pallet of metal that is easy to stack with the aid of forklifts.

This is achieved according to the invention through the loading pallet showing the characteristics that are principally described by patent claim 1.

A simple and stable pallet design with low weight is achieved through the loading pallet demonstrating bars of metal material, some of which are arranged parallel to each other and some of which are arranged transverse to these; while, furthermore, the loading pallet can consist of a low number of parts through certain of the said bars allowing the formation of spaces for lifting means between loading pallets that have been stacked on each other. The design of the loading pallet means also that it is easy to stack in a manner that saves space, also with the aid of forklifts or similar. The design of the loading pallet means also that it is particularly suitable for the application of pallet collars to the same, which pallet collars can be provided with covers such that flexible load containers can be achieved.

BRIEF DESCRIPTION OF THE DRAWINGS

The invention will be described in more detail below with reference to the attached drawings, of which:

FIG. 16 shows a loading pallet according to FIG. 1 with a pallet collar having an alternative design in its normal form and with ends that have been folded in;

DESCRIPTION OF EXEMPLARY EMBODIMENTS

Figure 19:
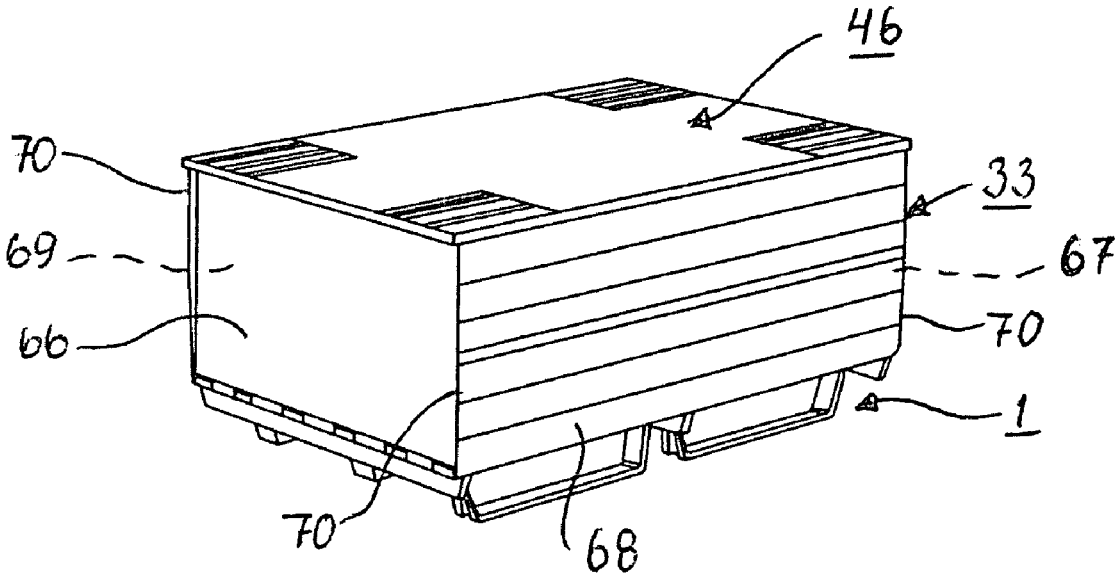
FIG. 19 shows a loading pallet according to FIG. 1 with a pallet collar with sides of an elastic material.

The loading pallet according to FIG. 19 demonstrates, for example, four first bars 2, three second bars 3, three third bars 4 and two fourth bars 5. These bars 2-5 consist of metal material, preferably of galvanized steel. The first bars 2 are essentially straight, extend between a first side 6 and the opposite second side 7 of the loading pallet 1, and are arranged in a plane 8 that the loading pallet 1 forms for the load that is to be placed on the same. The second bars 3 are arranged essentially parallel to the first bars 2, extend also between the sides 6, 7; and two first bars 2 are arranged between two such second bars 3 in the loading pallet according to FIG. 1. Each second bar 3 has upper parts 9 that lie in the said plane 8 and at least two downwardly directed parts 10 that are directed downwards relative to the plane 8. Each downwardly directed part 10 can demonstrate two downwardly directed parts 11 and a lower part 12. The downwardly directed parts 10 are intended to form supporting legs for the loading pallet 1 when this is placed onto a base 13, and they are arranged to form spaces 14 under the plane 8 that open out onto a third side 15 and an opposite fourth side 16 of the loading pallet 1. These spaces have a height h between the plane 8 and the lower part 12 that is equal to or preferably somewhat greater than the height h1 of lifting means 17 that can be introduced into the said spaces 14 in order to lift the loading pallet 1. Parts of the lifting means 17 are shown with dashed lines and they are preferably arranged on mobile lifting arrangements such as, for example, fork-lift trucks (not shown in the drawings). This design of the downwardly directed parts 10 allows the lifting means 17 to be introduced under the bars 3 and 5 that lie in the plane 8 from the third side 15 or from the fourth side 16 of the loading pallet 1, when the loading pallet 1 is located, for example, on the base 13, such that it can be lifted up from the base. Two downwardly directed parts 10 are so arranged in the design of the loading pallet 1 shown in FIG. 1 that one of the lifting means 17 of the lifting arrangement can be introduced into the space 14 of one of the downwardly directed parts 10, while the second can be introduced into the space 14 of the second downwardly directed part 10.

The downwardly directed parts can, furthermore, be so arranged that spaces 18 are formed between two neighbouring second bars 3, which spaces are open towards the first side 6 and second side 7 of the loading pallet and have such a height h1 between the third bars 4 and the base 13 that lifting means 17 can be introduced into the said spaces 18 from the said first side 6 and second side 7. The said spaces 18 are so arranged relative to each other in the design of the pallet shown in FIG. 1 that one of the lifting means 17 can be introduced into one space 18, while the second lifting means 17 can be introduced into the second space 18, when the loading pallet 1 is standing on the base 13.

Figure 1:
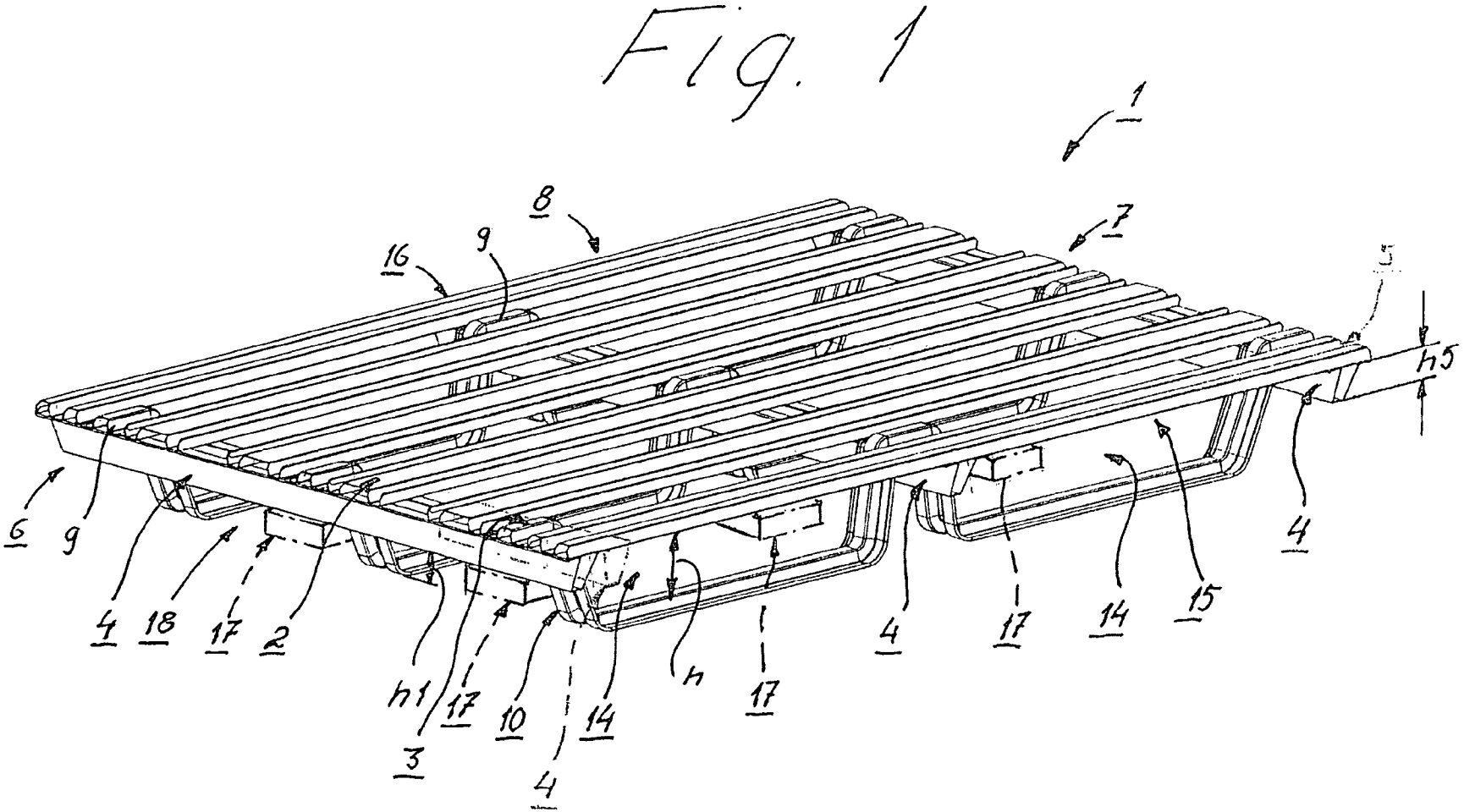
FIG. 1 shows a view in perspective of the loading pallet according to the invention.

The loading pallet 1 according to FIG. 1 has three third bars 4, two of which are arranged to extend along the first side 6 and the second side 7, while the third of which is arranged essentially parallel with the other two and lies essentially centrally in the loading pallet 1.

Every third bar 4 is arranged under the upper parts 9 of the second bars 3 and under parts of the first bars 2.

The two fourth bars 5 are essentially straight and parallel with the first bars 2. They constitute the outer bars of the loading pallet 1.

Figure 12:
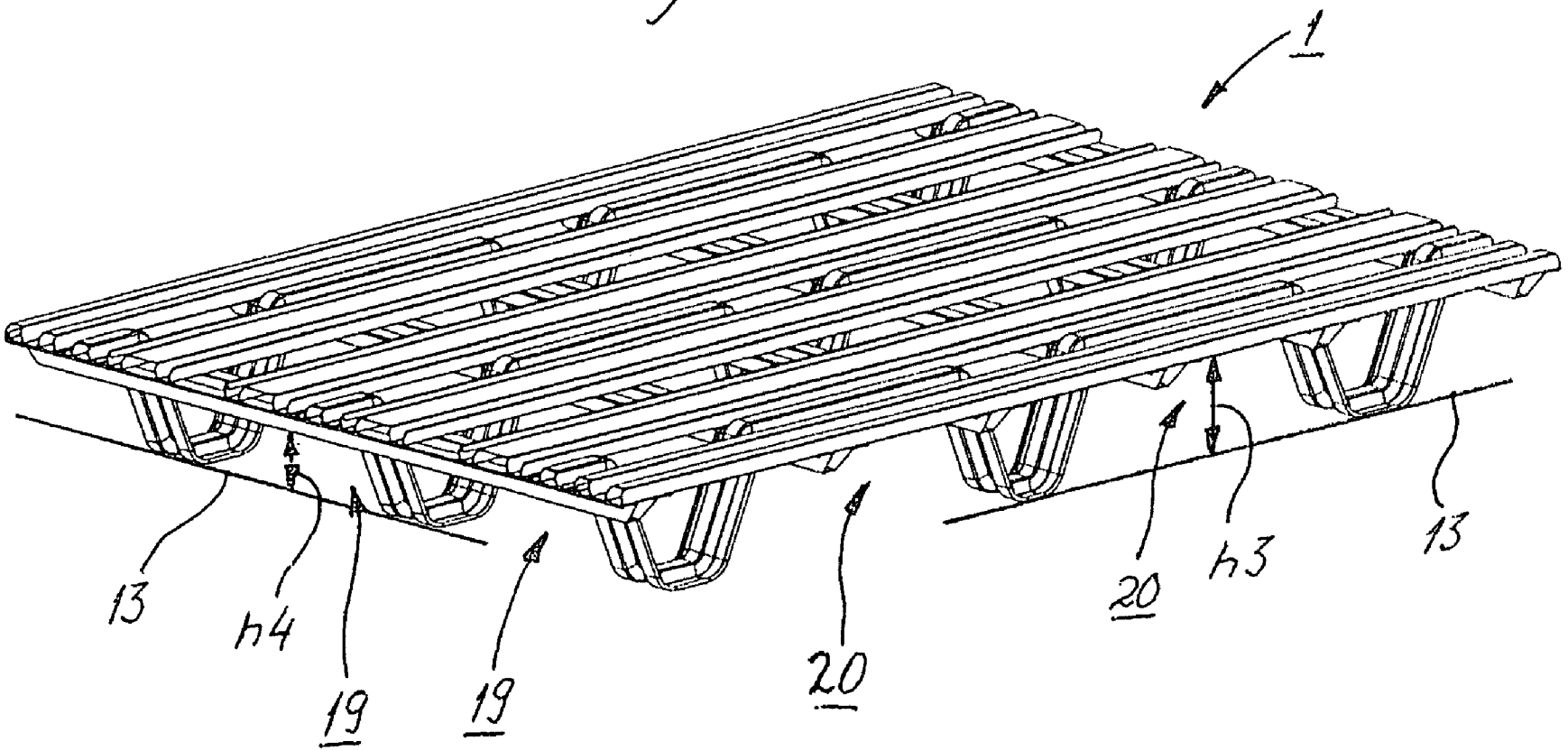
FIG. 12 shows a perspective view of a loading pallet according to the invention with an alternative design.
Figure 13:
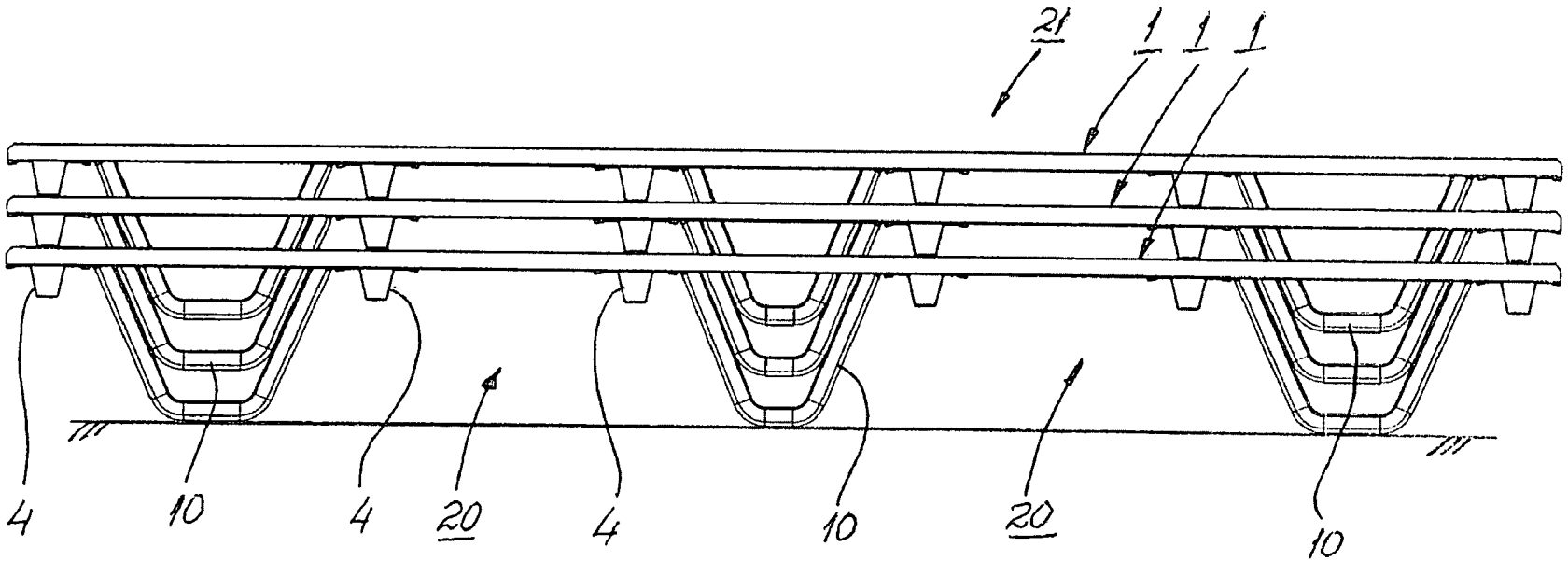
FIG. 13 shows three loading pallets according to FIG. 12 stacked onto each other.

The loading pallet 1 shown in FIG. 12 has large similarities with the loading pallet 1 according to FIG. 1 and the reference numbers from FIG. 1 have for this reason been maintained for equivalent parts in FIG. 12. That which distinguishes the design of the loading pallet 1 according to FIG. 12 from the design according to FIG. 1 is that the downwardly directed parts 10 of the second bars in the loading pallet 1 according to FIG. 12 have a different form, and that there are, for example, three such downwardly directed parts 10 instead of two on each second bar 3. Furthermore, there are six third bars 4, whereby two of these members are arranged to extend along the first side 6 and the second side 7 of the loading pallet 1, while two are placed in pairs between two neighbouring downwardly directed parts 10.

Each pair of neighbouring downwardly directed parts 10 in the design of the pallet according to FIG. 12 forms a space 20 between the downwardly directed parts with a height h3 between the base 13 and the plane 8 such that the lifting means 17 can be introduced into this space. The space 20 in the design shown is, furthermore, located between two third bars 4 that are located between each pair of downwardly directed parts 10. The two neighbouring spaces 20 are, furthermore, preferably arranged relative to each other such that one of the two lifting means 17 can be introduced into it from the third side 15 or the fourth side 16 of the loading pallet 1.

The downwardly directed parts 10 may also in this case be so arranged that spaces 19 are formed between two neighbouring second bars 3, which spaces are open towards the first side 6 and second side 7 of the loading pallet 1, and have a height h4 between the third bars 4 and the base 13 such that the lifting means 17 can be introduced into the said spaces 19.

The loading pallets according to FIGS. 1 and 12 can be stacked onto each other, whereby the downwardly directed parts 10 of a loading pallet 1 can be caused to protrude downwards into the upwardly open parts of the spaces 14 that are formed by downwardly directed parts 10 of a loading pallet 1 that is located underneath in the stack 21.

The third bars 4 are arranged so that third bars 4 of a loading pallet 1 will, during stacking, make contact with the first bars 2 and preferably the upper parts 9 of the second bars 3 of a loading pallet 1 located below.

The said third bars 4 have been designed with a height h5 that is equal to or greater than the height of the lifting means 17. The third bars 4 will in this manner ensure that the distance between the planes 8 of two loading pallets 1 that are stacked on top of each other will correspond to the height h5 of the third bars 4, i.e. the height h5 of the space 22 will be equal to or greater than the height of the lifting means 17, and this means that the lifting means 17 can be introduced into the said spaces 22, and that it can be withdrawn from these spaces. This means that it is possible not only to lift the complete stack 21 with the aid of lifting means 17 but also to lift one, two or any other suitable number of loading pallets 1 from the stack 21.

The said spaces 22 in the design of the loading pallet 1 shown in FIG. 1 comprise in the stack 21 parts of the spaces 14 that are formed inside the downwardly directed parts 10, while the said spaces 22 in the design of the loading pallet 1 shown in FIG. 12 comprise parts of the spaces 20 between the downwardly directed parts 10.

Figure 4:
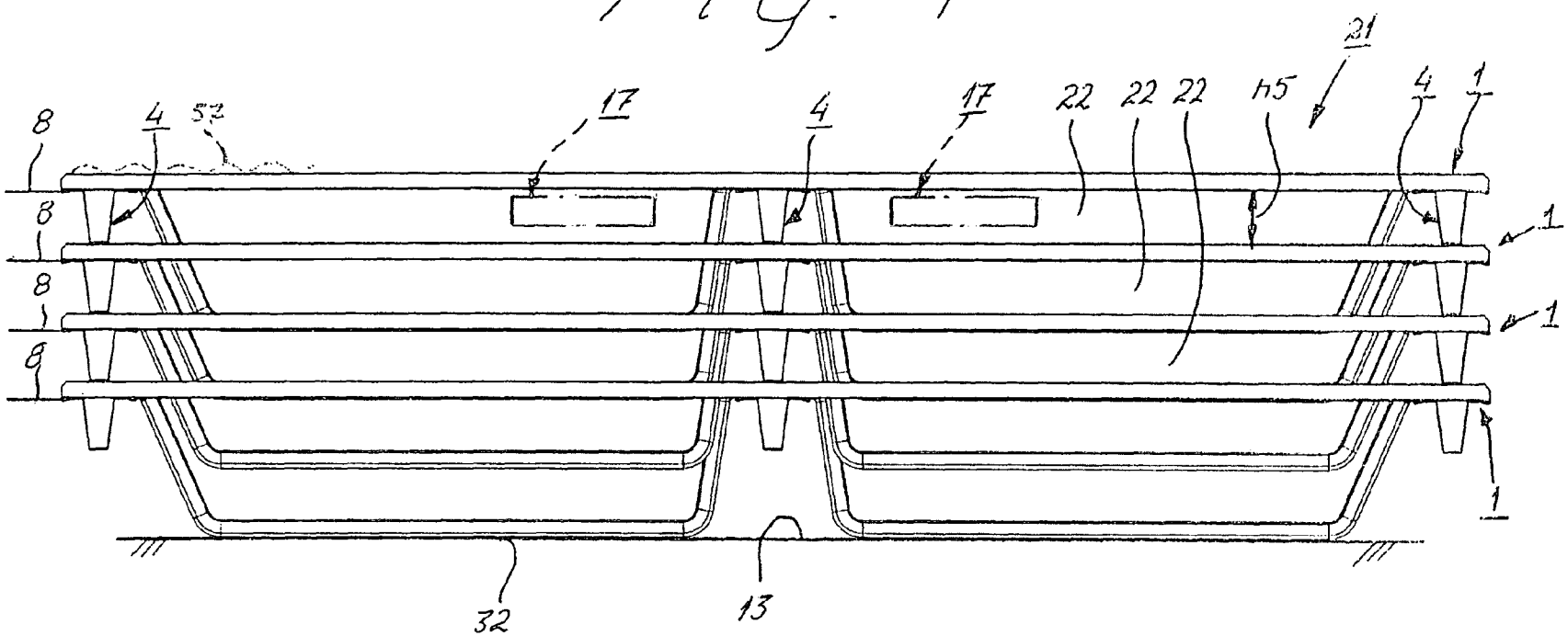
FIG. 4 shows loading pallets according to FIG. 1 stacked onto each other.
Figure 5:
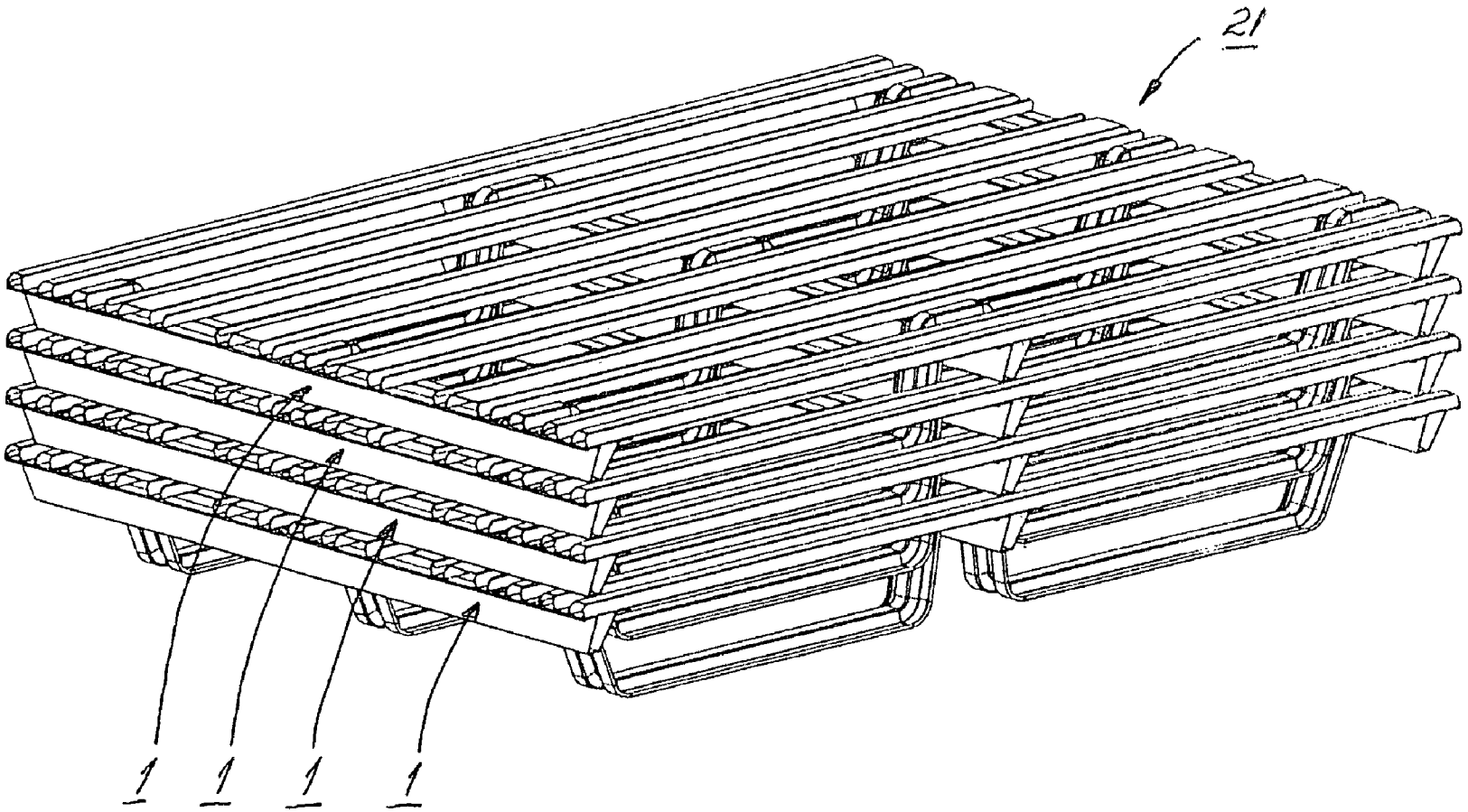
FIG. 5 shows a perspective view of four loading pallets according to FIG. 1 stacked onto each other.

FIG. 4 makes it clear that the spaces 14 that are formed by the downwardly directed parts 10, among other elements, are comprised by the spaces 22 between two loading pallets 1 that are stacked onto each other.

The downwardly directed parts 10 can be so arranged that lower parts 12 of the downwardly directed parts 10 of a loading pallet 1 can essentially lie in the same plane 8 as a third loading pallet 1 located below the said loading pallet 1, when the loading pallets 1 are stacked on top of each other.

Figure 2:
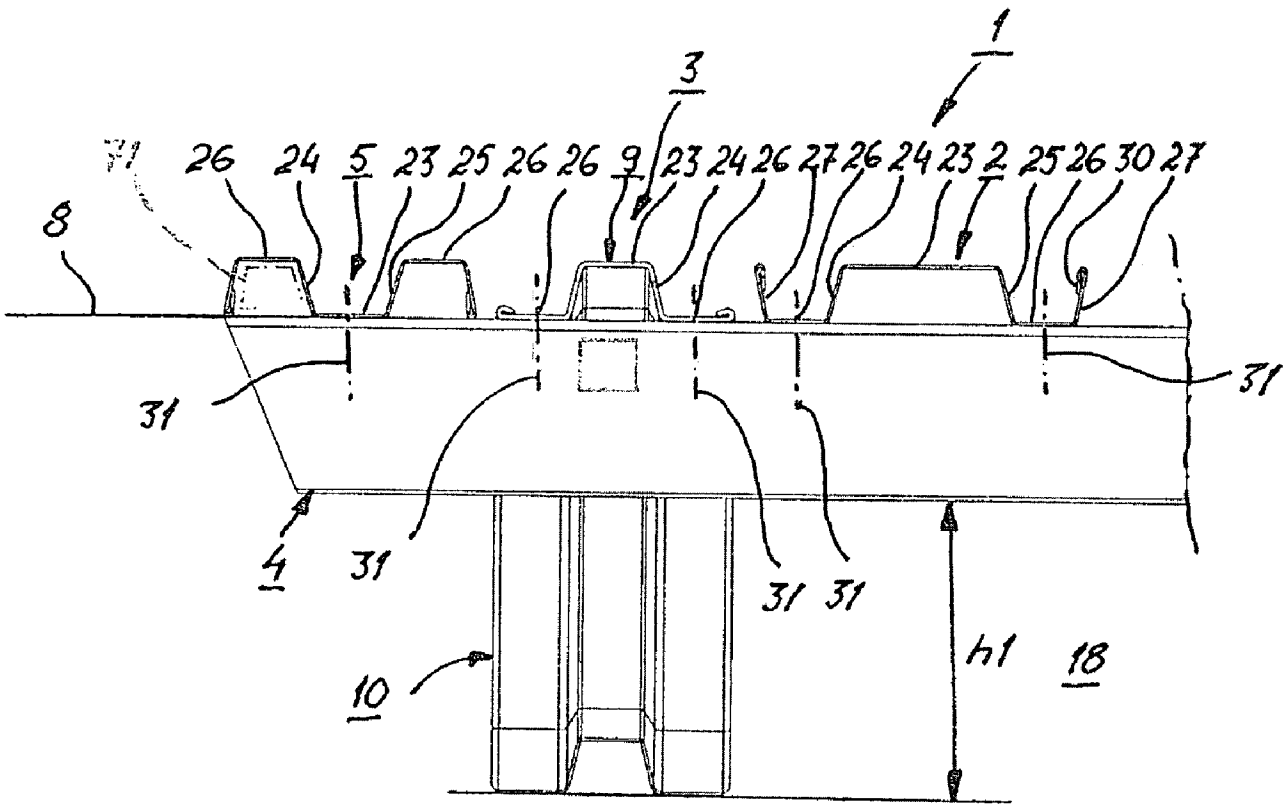
FIG. 2 shows an end part of the loading pallet according to FIG. 1.
Figure 3:
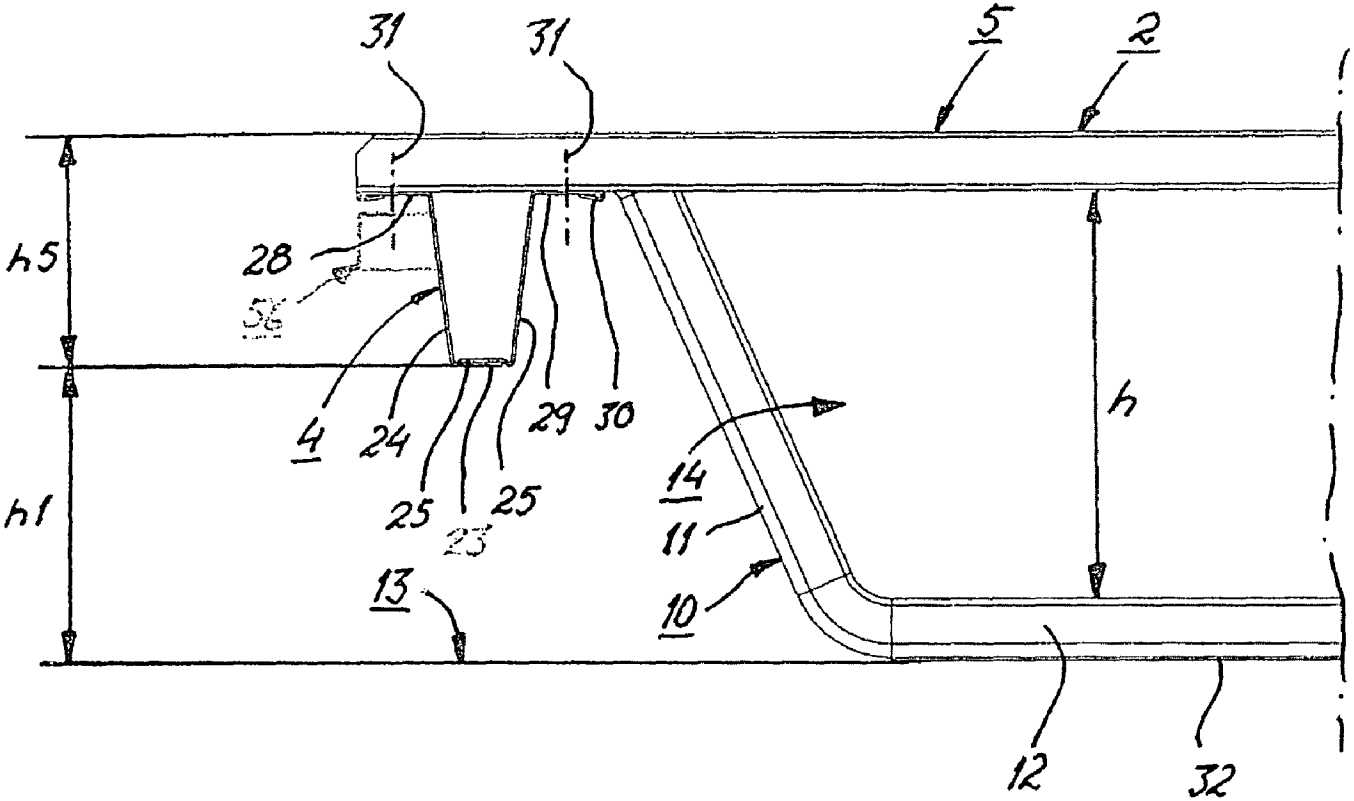
FIG. 3 shows a second view of an end part of the loading pallet according to FIG. 1.

The bars 2-5 may demonstrate suitable profiles, they may, for example, demonstrate essentially U-shaped basic shapes with a central part 23 and two legs 24, 25 that extend from this (see FIGS. 2 and 3). FIG. 2 makes it clear that the first bars 2 and the second bars 3 can be arranged with their central parts 23 lying above the said plane 8, i.e. at the top, with their legs 24, 25 directed downwards. Flanges 26 may extend from the legs 24, 25, which flanges may lie in the said plane 8 and be attached to the third bars 4. The flanges 26 on the first bars 2 may demonstrate upwardly directed flange parts 27 that extend upwards from the said plane 8 and terminate at the level of the central parts 23.

FIG. 3 makes it clear that the third bars 4 may demonstrate flanges 28, 29 that extend from the legs 24, 25. These flanges 28, 29 may lie in the plane 8 and they may be attached to the first bars 2 and the upper parts 9 of the second bars 3.

Some or all of the bars 2-5 may demonstrate inwardly folded edge parts 30.

The first 2, second 3 and possibly also the fourth 5 bars may be connected to the third bars 4 by hollow rivets 31, which have been schematically drawn with dashed lines in FIG. 3. These may have been applied by being riveted through parts of the bars in question without holes.

The lower parts 12 of the downwardly directed parts 10 of the second bars 3 may demonstrate layers or elements 32 that counteract sliding. These may consist of or they may demonstrate aluminium, and they may be riveted to the lower parts 12 with the aid of hollow rivets 31.

Figure 6:
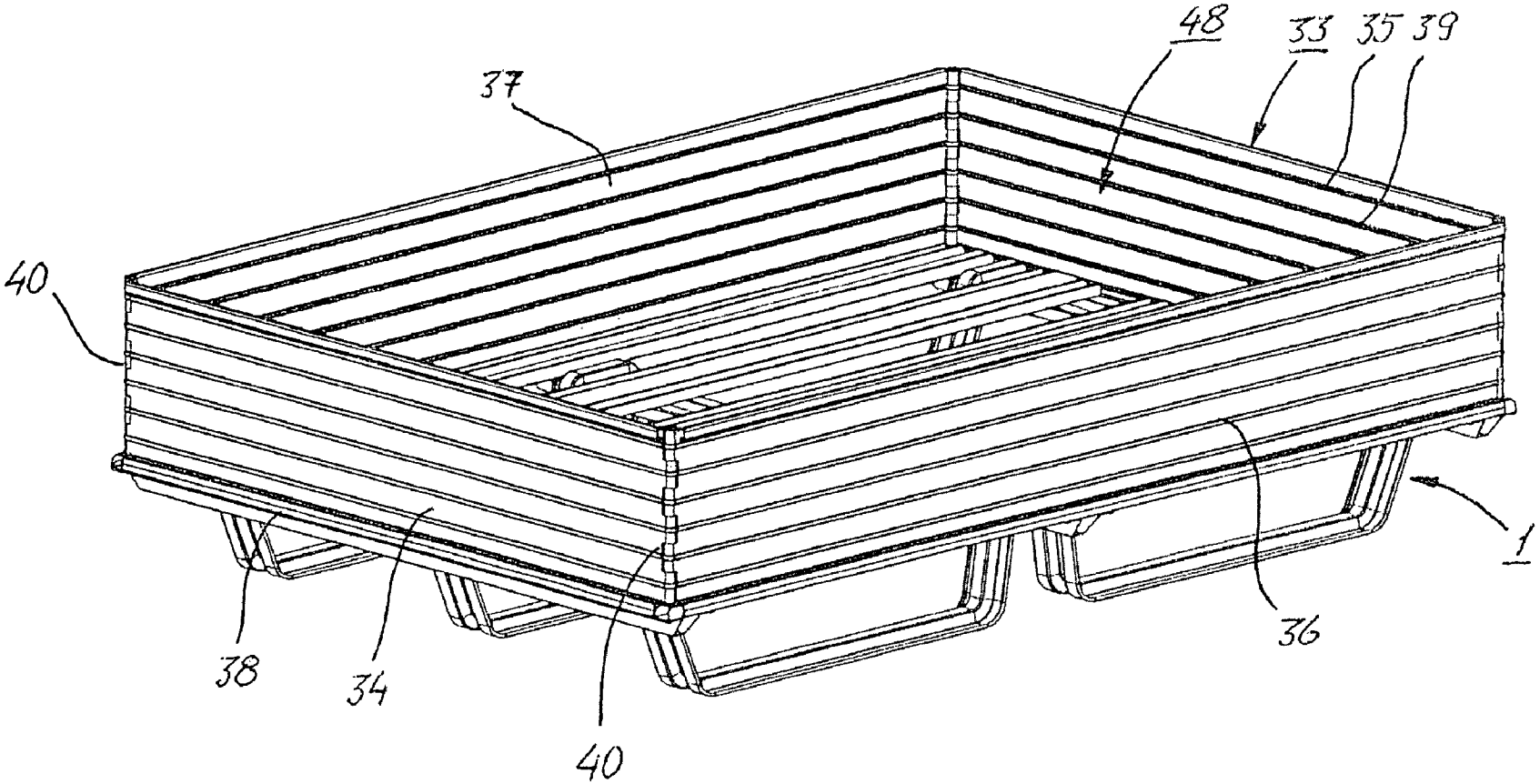
FIG. 6 shows a perspective view of a loading pallet according to FIG. 1 with a pallet collar placed on it.
Figure 7:
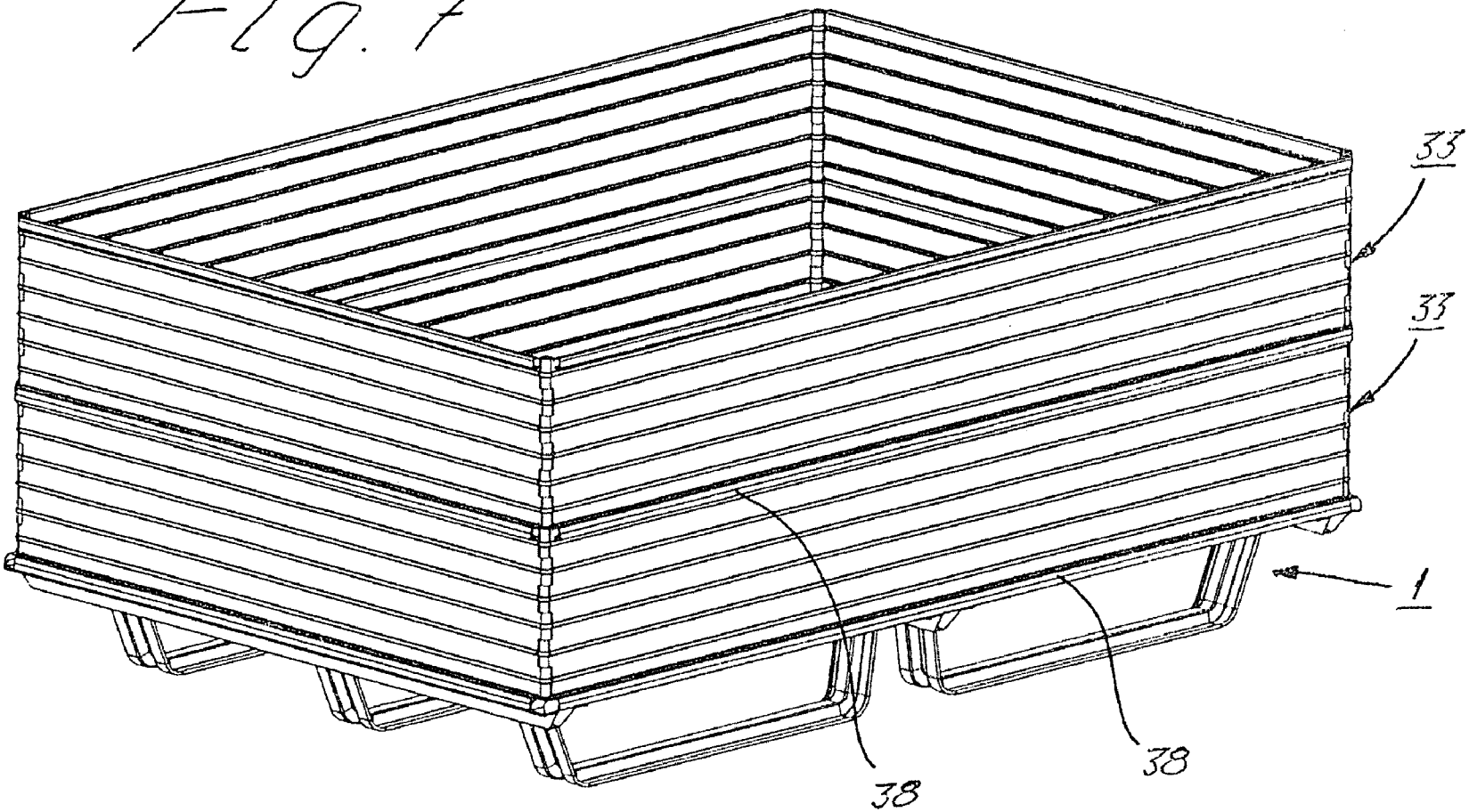
FIG. 7 shows a perspective view of a loading pallet according to FIG. 1 and two pallet collars placed onto the loading pallet and on top of each other.
Figure 8:
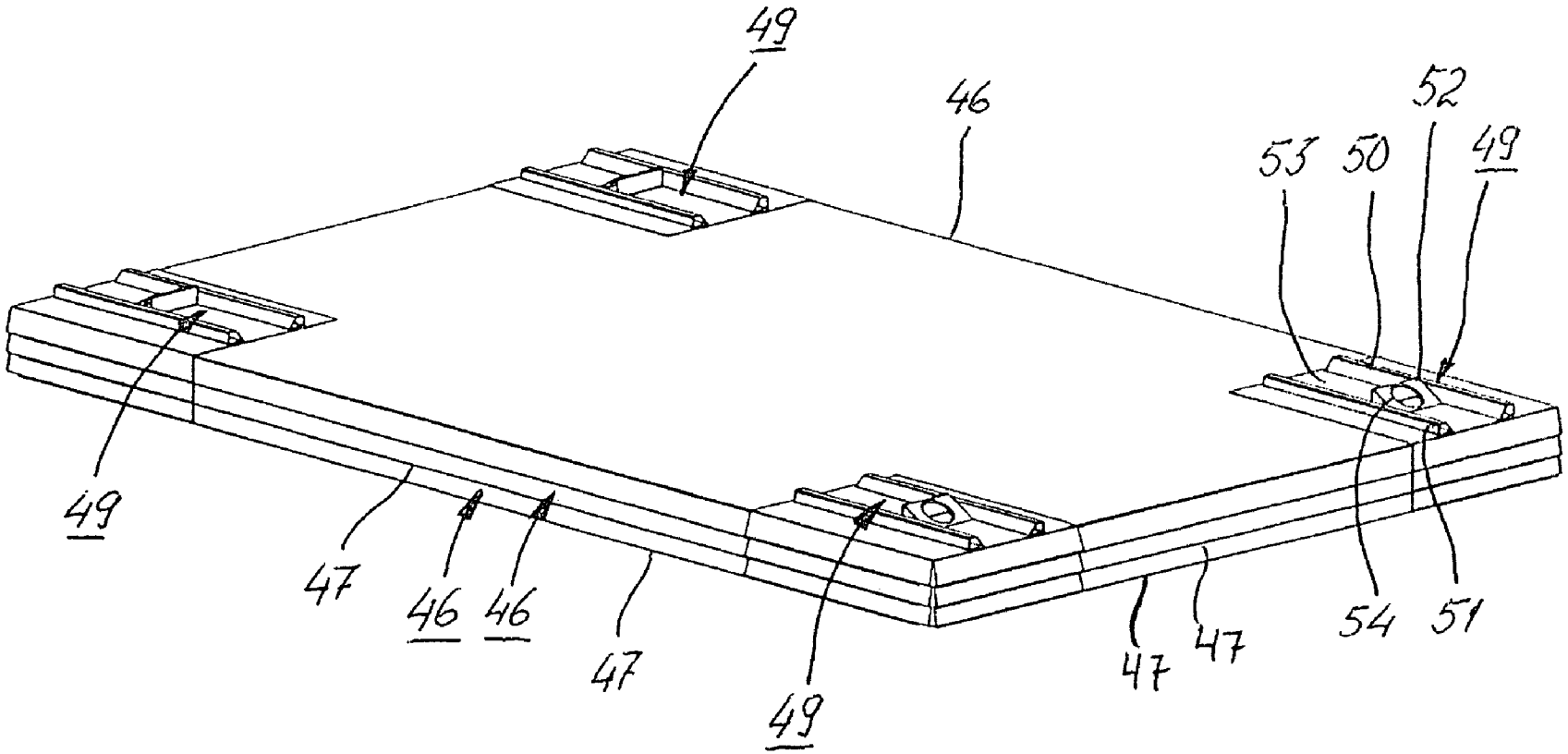
FIG. 8 shows a perspective view of three covers for pallet collars stacked on top of each other.

FIG. 6 makes it clear that each loading pallet 1 can be provided with at least one pallet collar 33 of metal material, such as, for example, galvanised sheet metal. The side walls 34-37 of the pallet collar 33 have gripping parts 38 at the bottom that grip around the equivalent bars 2-5 of the loading pallet 1 such that the pallet collar 33 cannot slide off from the loading pallet 1.

These gripping parts 38 may be designed as integral parts of the relevant side wall 34-37.

Figure 11:
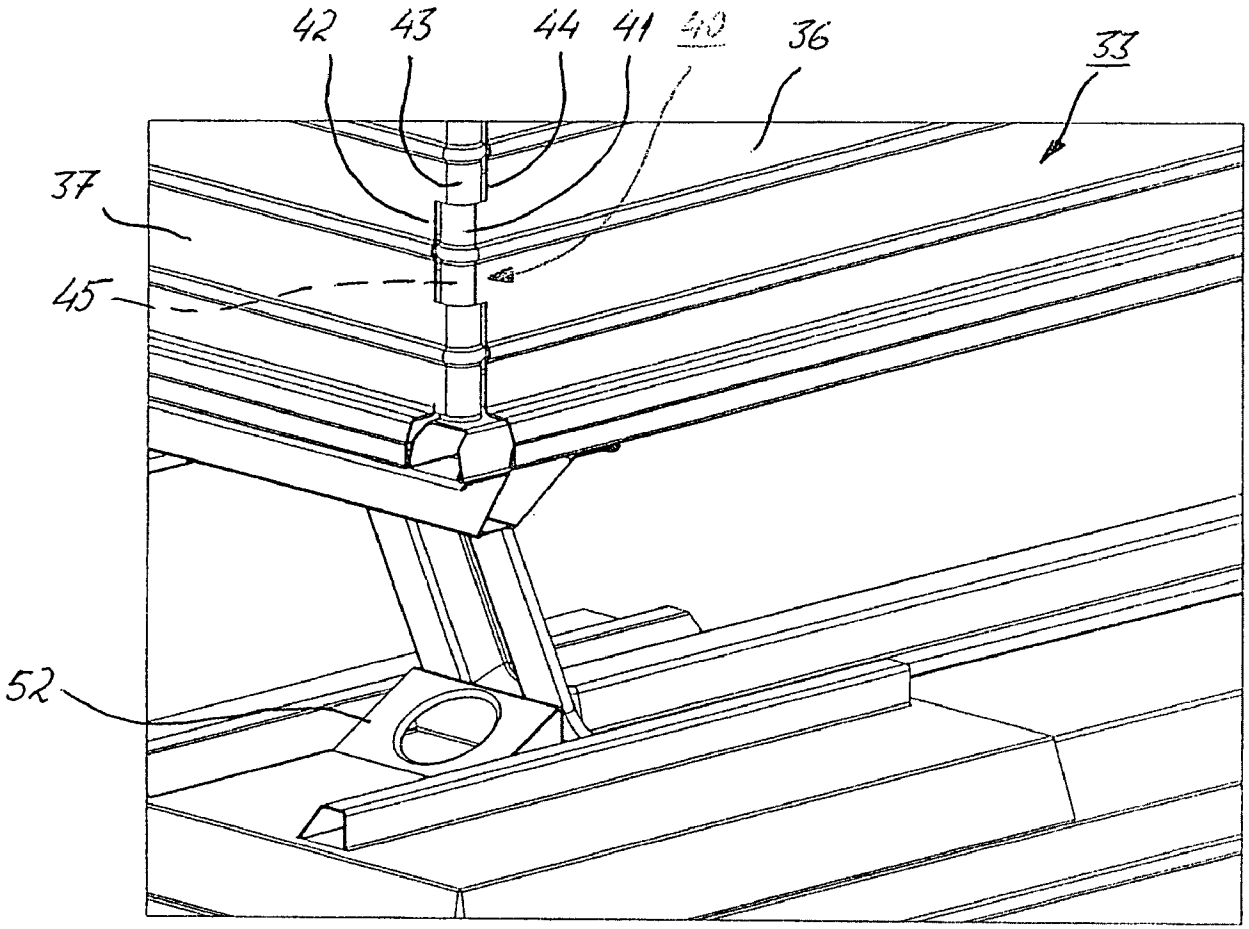
FIG. 11 shows a perspective view of an enlarged part of FIG. 10.

The side walls 34-37 may demonstrate longitudinal stiffening ridges 39 that may be formed by pressure from the wall material, preferably by rolling this material. The side walls 34-37 may be attached by joints with each other using hinges 40 such that the pallet collar 33 can be folded together to an essentially flat unit. FIG. 11 makes it clear that the hinges 40 may consist of tabs 41 along one side wall, such as the side wall 36, that are inserted into recesses 42 in a neighbouring side wall, such as the side wall 37. The side wall 37 may in turn demonstrate tabs 43 that are inserted into recesses 44 in the side wall 36.

These tabs 41, 43 may be designed as tube-shaped parts that grip a shaft 45, for example a tube part, in a manner that allows pivoting, such that the hinge 40 is formed by parts of the side walls 34-37 and the said shaft 45.

A cover 46 may be placed onto the pallet collar 33 in order to cover a space 48 inside of the pallet collar. This cover preferably consists of galvanised metal material and it may have dimensions and it may demonstrate edges 47 that extend across the side walls 34-37 of the pallet collar 33 such that the edges 47 prevent either water or objects, or both, from entering the space 48 within the pallet collar 33. In this way, damage is prevented to objects that are placed in the space 48 and sensitive to, for example, at least one of water and heat.

Figure 9:
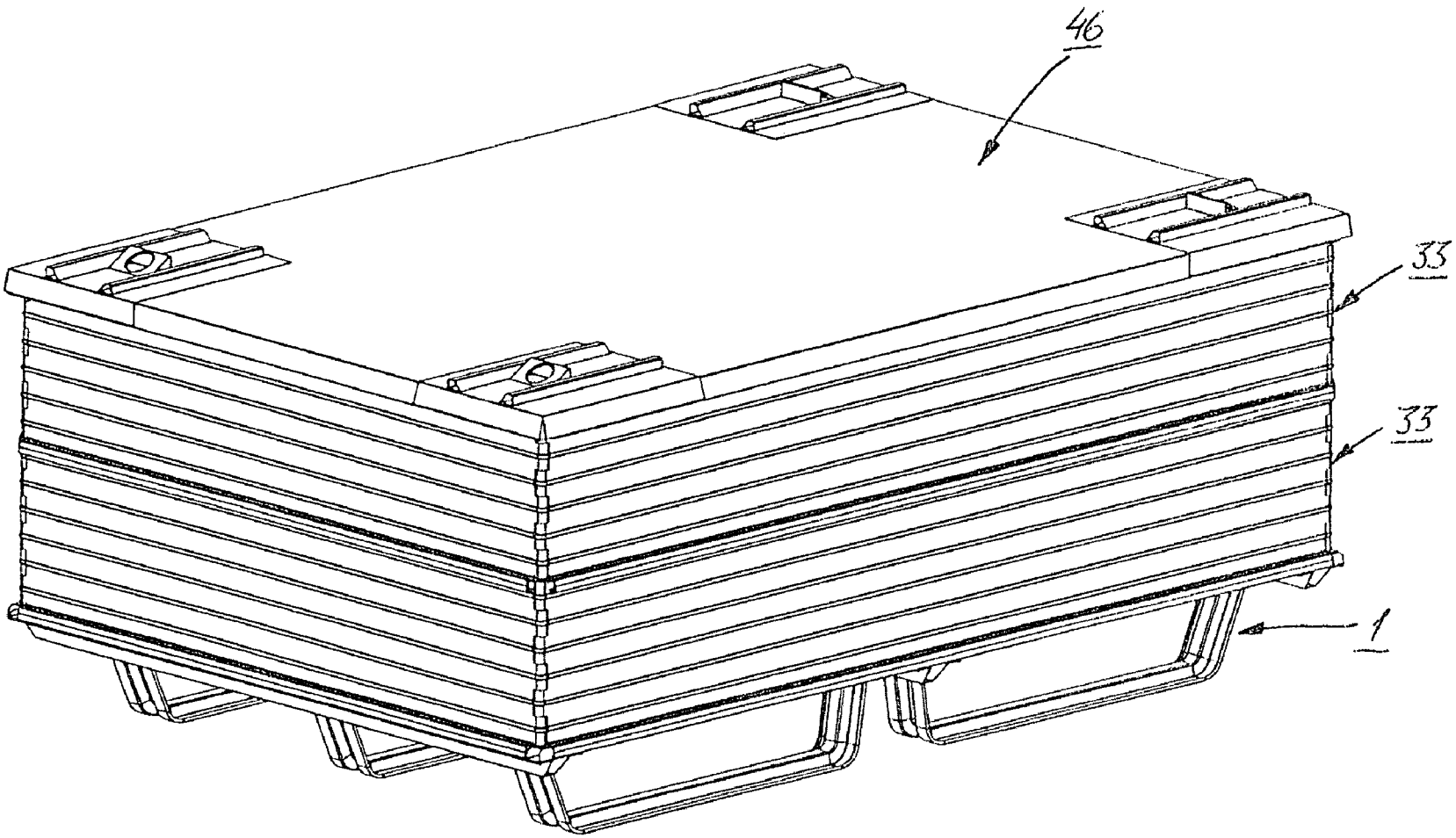
FIG. 9 shows a perspective view of a loading pallet according to FIG. 1 with two pallet collars placed on top of each other and with one cover.

FIG. 9 makes it clear that the cover 46 may be so designed that it allows the placement of a pallet collar 33 onto it. This means that the cover 46 forms a cover for the space 48 underneath it on the loading pallet 1 and the bottom of a space 48 that is formed by the pallet collar 33 that is placed on it. A cover 46 can, in turn, be placed onto the latter pallet collar 33 in order to seal the space 48 in this pallet collar.

Figure 10:
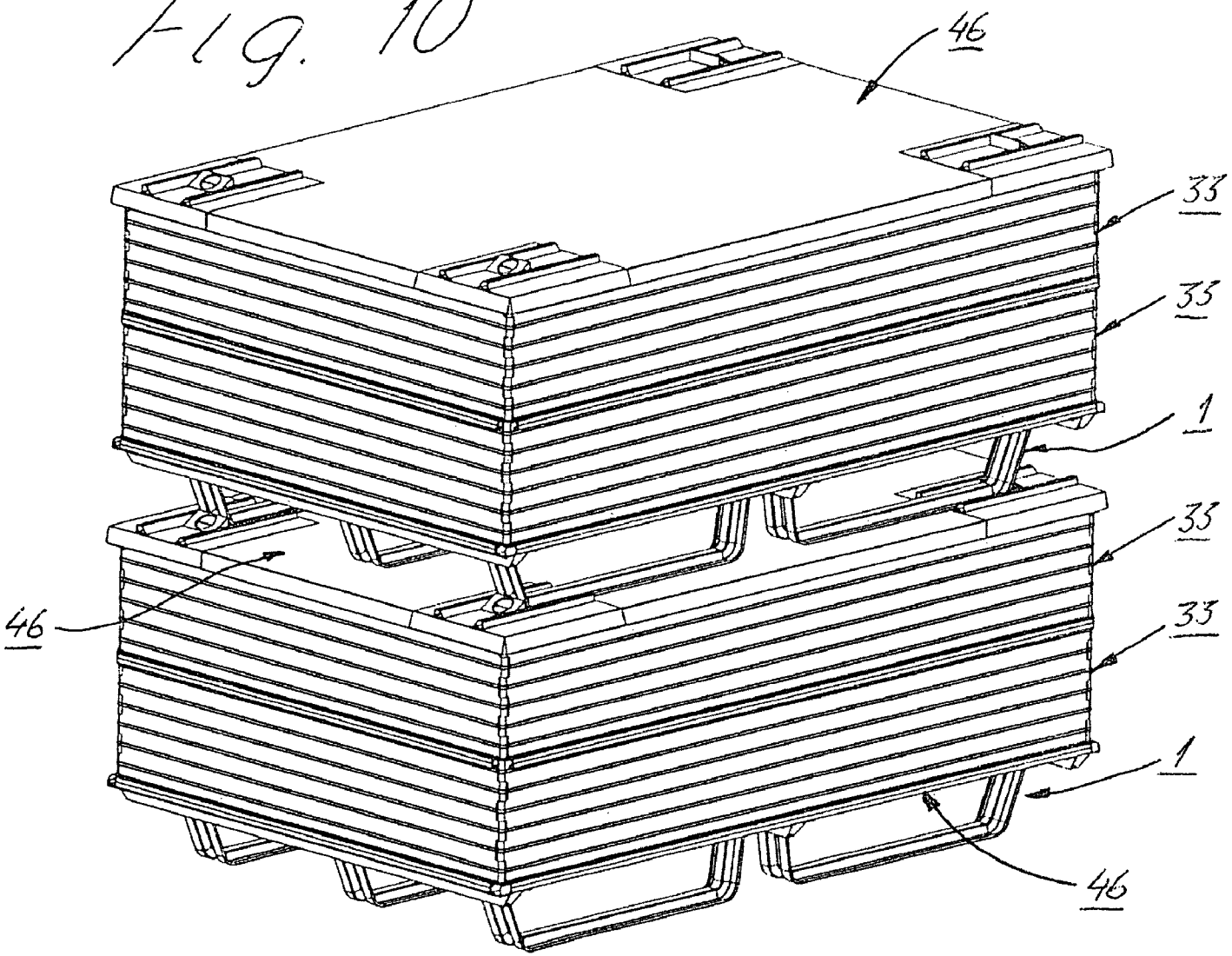
FIG. 10 shows a perspective view of a loading pallet according to FIG. 1 with two pallet collars placed on top of each other and with one cover; together with, placed on top of this cover, a loading pallet according to FIG. 1 with two pallet collars placed on top of each other and with one cover.

FIG. 10 makes it clear that the cover 46 may be so designed to allow a loading pallet 1 to be placed onto it. In order to prevent this loading pallet 1 from sliding off from the cover 46, the four corners parts of the cover 46 may demonstrate upwardly pointing slide preventers 49 that are intended to prevent the loading pallet 1 from sliding off from the cover 46. Each slide preventer 49 may consist of three upwardly directed parts 50-52 that together form a channel 53 in which a downwardly directed part 10 of a loading pallet 1 that has been placed on the cover 46 can be placed. One of the upwardly directed parts 50-52, for example the part 52, can demonstrate a hole 54 into which fingers can be introduced in order to obtain a hold on the cover 46 when it is to be lifted.

FIG. 10 makes it clear that a cover 46 may be placed onto the pallet collar 33 and in this way form a bottom for a space 48 that the pallet collar 33 forms on this cover 46 above the loading pallet 1.

Figure 14:
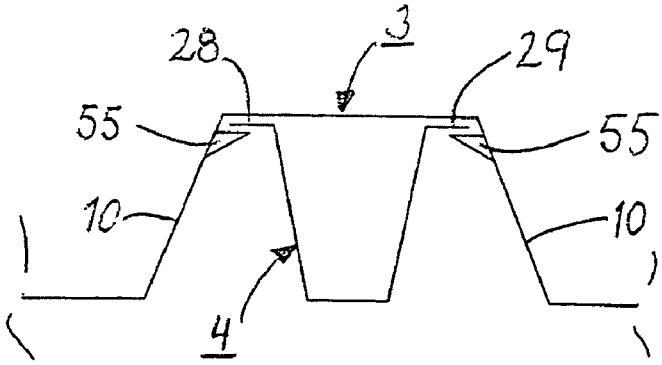
FIG. 14 shows schematically parts of the loading pallet according to FIG. 1.
Figure 15:
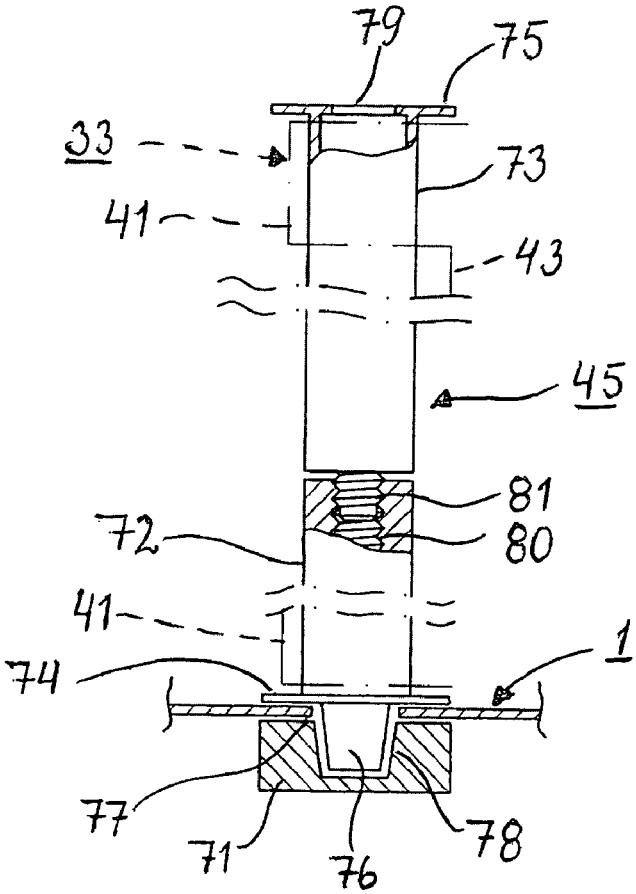
FIG. 15 shows a side view of a shaft that is intended for a pallet collar according to FIG. 6.
Figure 16:
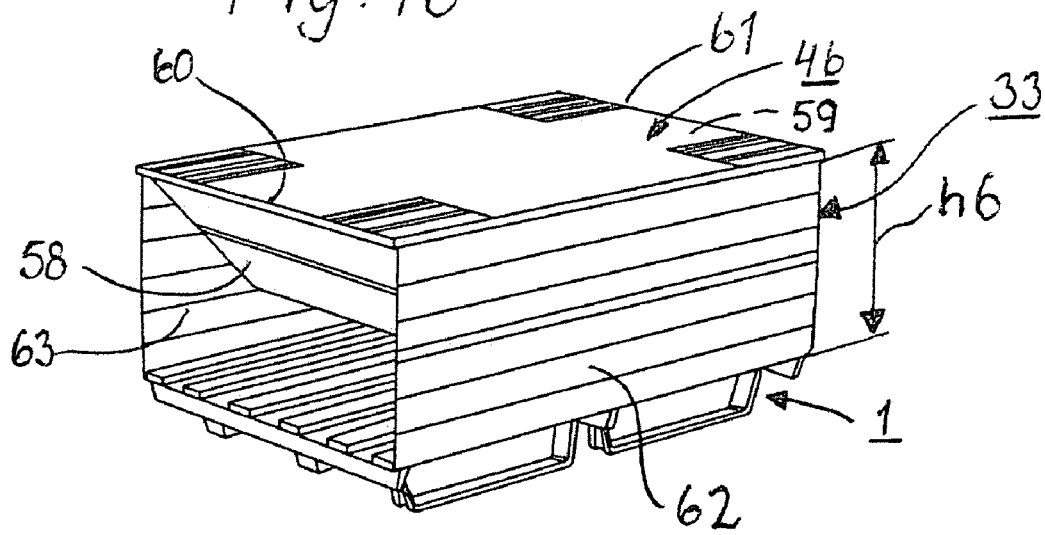
Figure 17:
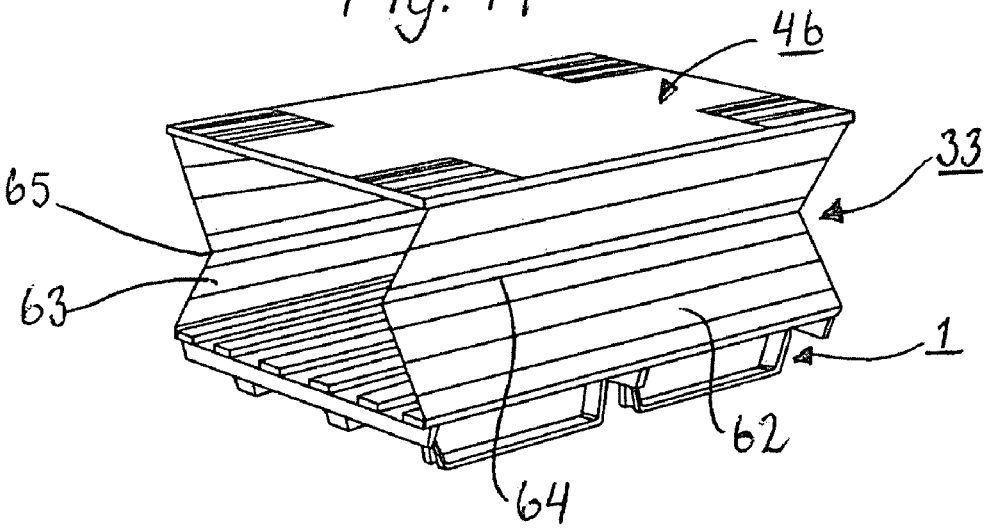
FIG. 17 shows the pallet collar according to FIG. 16 during the folding in of its sides.
Figure 18:
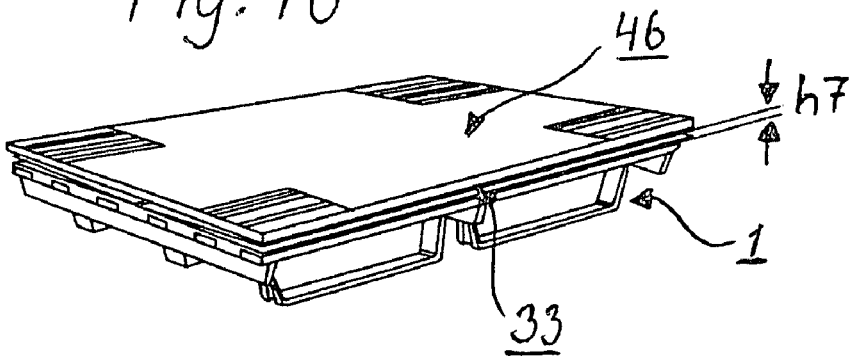
FIG. 18 shows the pallet collar according to FIGS. 16 and 17 in its fully folded condition.

Each one of the downwardly directed parts 10 of the second bars 3 may demonstrate a support part 55, in order to increase the ability of the loading pallet 1 to support heavy weights. The flanges 28, 29 of the third bars 4 lie in contact with these support parts 55, which in this way support the third bars 4 from underneath (see FIG. 14).

A transponder 56 may be arranged on any one of the parts of the loading pallet 1, well-protected, for example, by one of the third bars 4 (see FIGS. 2 and 3) in order to receive or to transmit, or both, radio signals, in order to, for example, determine the position of the loading pallet 1. These signals may also be used to determine when the loading pallet 1 is displaced; they may be used to determine the destination to which it has been displaced, and they may be used to determine how it has been displaced. The transponder 56 may be of the RFID type, and it is so located on the loading pallet 1 that the radio signals either to or from, or both, the transponder are not interrupted by the metal parts of the loading pallet. The transponder 56 may be of an active type with an integral source of power, or it may be a passive type without such a source.

The loading pallet 1 may demonstrate a net or similar, as has been suggested in FIG. 4, in order to prevent objects falling down between the gaps between the bars. The net may also prevent either objects or animals, or both, from penetrating upwards through the bars.

FIGS. 16-20 make it clear that the pallet collar 33 may be designed in different ways and it may be possible to fold it down, fold it together, or fold it away it such that its minimum height h7 is much less than its maximum height h6. This change of height of the pallet collar 33 preferably takes place when the pallet collar 33 has been placed onto the loading pallet 1, but it may, naturally, take place also when the pallet collar 33 has been removed from the loading pallet 1. FIGS. 16-20 make it clear that the height of the pallet collar 33 can be changed when the cover 46 has been placed on it.

In order to allow the change of height of the pallet collar 33, this may be designed in various ways, as has been shown in the said FIGS. 16-20. Thus, the pallet collar 33 demonstrates according to FIGS. 16 and 17 two ends 58, 59 that are suspended from the sides 62, 63 in a manner that allows them to pivot at the top through joints 60, 61, thus allowing them to be folded inwards or upwards. The sides 62, 63 have joints 64, 65 at the centre, which allows them to be folded inwards at the centre when the ends 58, 59 are folded inwards (see FIG. 17). The pallet collar 33 can in this way be laid down onto the loading pallet 1 with the various parts of its ends 58, 59 and sides 62, 63 close to each other such that it achieves a very small height h7 (see FIG. 18).

Figure 20:
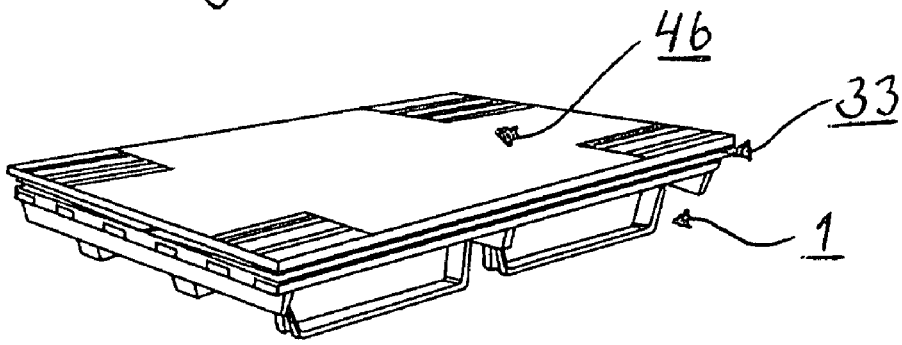
FIG. 20 shows the pallet collar according to FIG. 19 in its fully folded condition.

FIGS. 19 and 20 make it clear that the pallet collar 33 may instead demonstrate ends and sides 66-69 of elastic material and that it may be possible to fold these in towards each other such that they can be laid down onto the loading pallet 1 such that the maximum height h6 of the pallet collar 33 is reduced to a much smaller height h7 (see FIG. 20). The elastic walls 66-69 of the pallet collar 33 may be held up by four stiff corner posts 70 that can be attached to the loading pallet 1 in a standing position and be removed or folded down when the walls 66-69 are to be folded down. The cover 46 may be placed onto the corner posts 70, it may be supported by these posts and allow that they remain in their vertical positions.

The shafts 45 of the joints that have been designed as hinges 40 in the design according to FIG. 11 may be supported by a support part 71 on the loading pallet 1 when the pallet collar 33 has been arranged on the loading pallet. The shaft 45 may demonstrate a lower shaft part 72 and an upper shaft part 73. The lower shaft part 72 may demonstrate a lower collar 74 and the upper shaft part may demonstrate an upper collar 75. The lower shaft part 72 may, furthermore, demonstrate a downwardly directed peg 76 at its end that is intended to be introduced into a hole 77 in one part of the loading pallet 1 and preferably in a hole 78 in the support part 71 when the pallet collar 33 has been placed onto the loading pallet 1. The upper collar 75 may demonstrate a hole 79 to allow the introduction of a peg 76 at the end of a pallet collar 33 that has been placed on top. The lower shaft part 72 may demonstrate at its top a threaded hole 80, and the upper shaft part 73 may demonstrate a threaded screw 81, to allow the shaft parts 72, 73 to be screwed together, whereby it is then possible to pull together two or more parts of the pallet collar 33, in the event that this consists of such.

The ends and sides 66-69 of the pallet collar 33 may consist of double walls of elastic material. Gas at a pressure greater than atmospheric pressure may be placed into a space between these walls, or there may be gas of another type than air; an inert gas, for example, such as argon, which may be at a pressure greater than atmospheric or not, and there may be also a control arrangement (not shown in the drawings) in order to monitor at least one of the pressure of the gas and changes in its composition. It is possible in this manner to determine whether the walls are leaking, as a result of, for example, being damaged, and it is possible to determine whether the sides of the pallet collar 33 have been damaged since the pressure in the intermediate space will in this case have fallen.

The elastic walls of the pallet collar 33 may consist of or demonstrate Kevlar, and they may be placed onto the loading pallet 1. The sides of the pallet collar 33 may be transparent.

There may be several third bars 4 for the purposes of reinforcement, and these may be arranged in the vicinity of the two outer bars of the third bars 4, and they may extend between a fourth bar 5, a second bar 3 and a first bar 2, as has been suggested in FIG. 1.

Figure 2A:
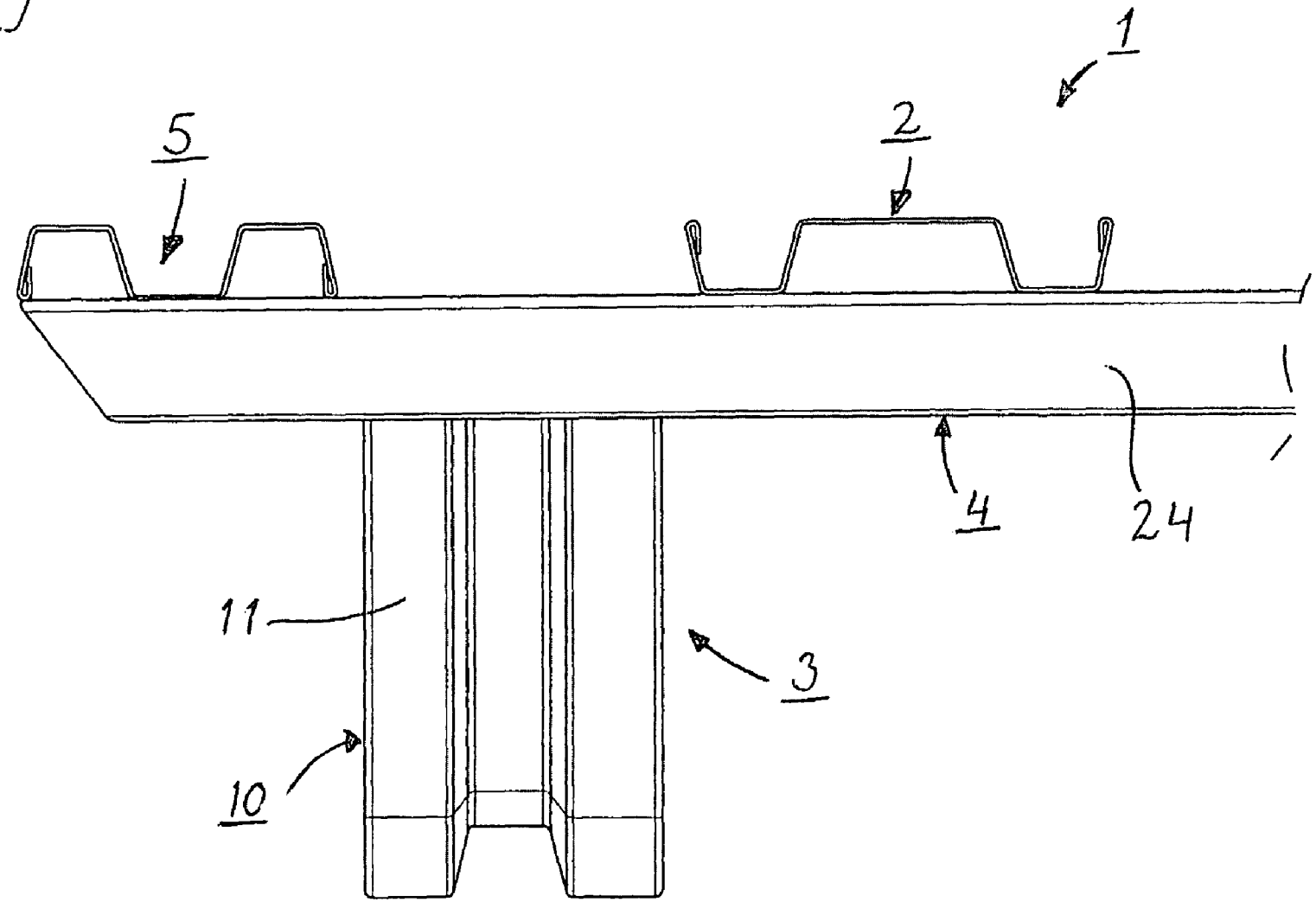
FIG. 2*a* shows schematically an alternative design of the end part according to FIG. 2.
Figure 3A:
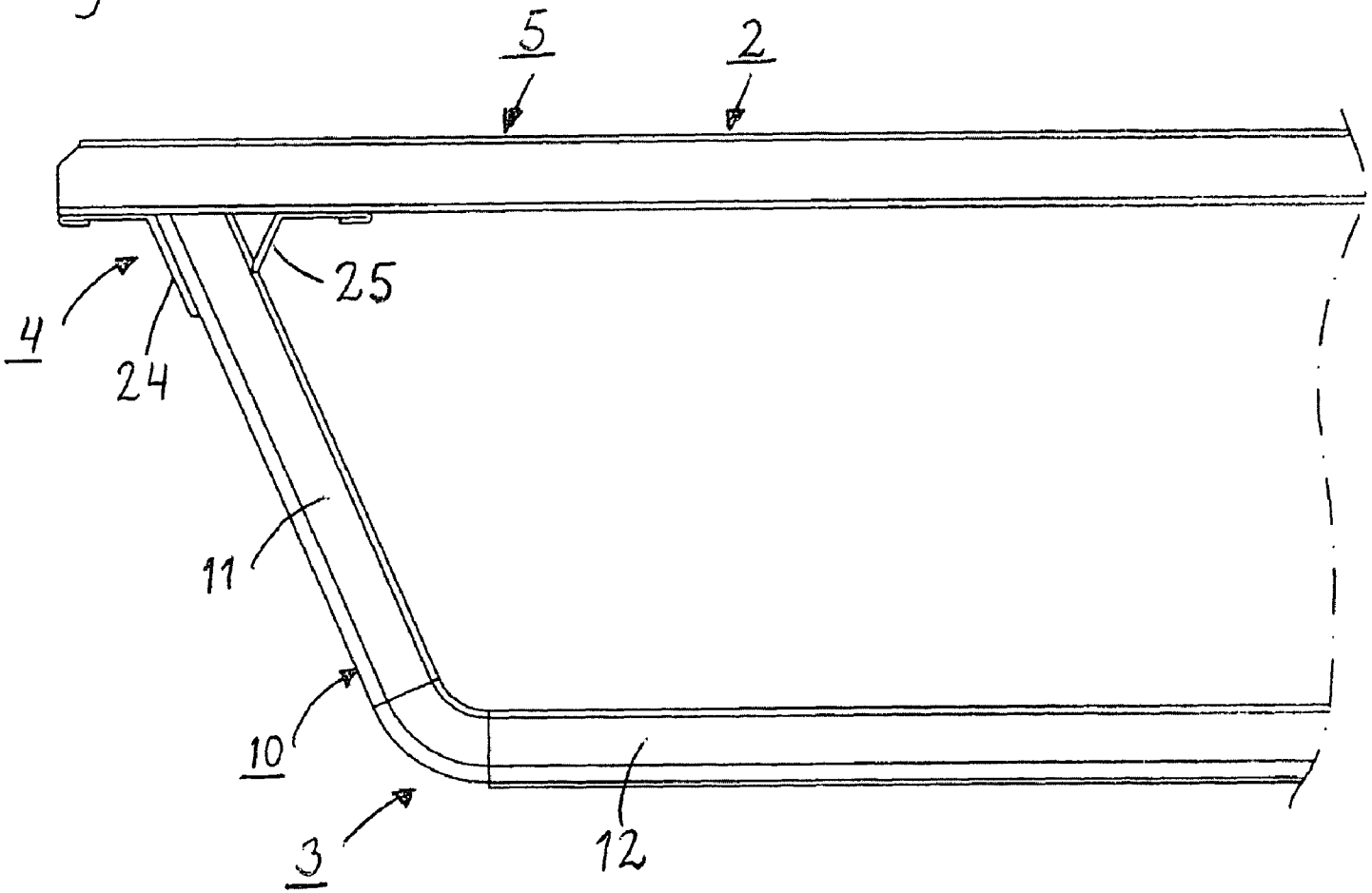
FIG. 3*a* shows schematically an alternative design of the end part according to FIG. 3.

It is possible, as an alternative, with the aim of being able to place the downwardly directed parts 10 of the outer bars 3 as close as possible to the outer edge of the sides 6, 7, such that the loading pallet 1 will stand stably in a pallet holder, to create recesses in the central parts 23 and the legs 25 of the third bars 4 at the said sides 6, 7, and the outer downwardly directed part 11 of the relevant downwardly directed part 10 can be caused to run through the said recesses out to the leg 24 and thus to run more closely to the said outer edge of the sides 6, 7, and to remove the associated upper part 9 of the relevant second bar 3, such that a design is achieved that has been shown in a highly schematic manner in FIGS. 2*a* and 3*a*.

A further alternative can be mentioned in which the intermediate second bar 3 of the design according to FIG. 1 can be removed, and only the two outer second bars 3 retained in any one of the specified designs of these second bars 3.

If it is possible to stack the covers 46 on top of each other, these may demonstrate protruding pegs (not shown in the drawings) that prevent the covers from becoming squeezed onto each other when stacked.

The invention is not limited to the designs described above and illustrated in the drawings: it can vary within the framework of the attached patent claims. For example, it can be mentioned, as an alternative of the parts of the invention that are not shown, that the loading pallet 1 can demonstrate bars additional to those shown, the bars can demonstrate another shape of their profile, and they can also otherwise demonstrate another form. Furthermore, the bars, possibly also the pallet collar, and possibly also the covers, may consist of another metal material than galvanised metal material, namely, for example, aluminium or titanium. The said parts may, as an alternative, consist of another material than metal material, namely, for example, a composite material. The bars may be attached to each other by hollow rivets through parts that have been provided with holes. As an alternative, the bars may be attached to each other by another method than riveting, namely, for example, by welding or by gluing.

Figure 21:
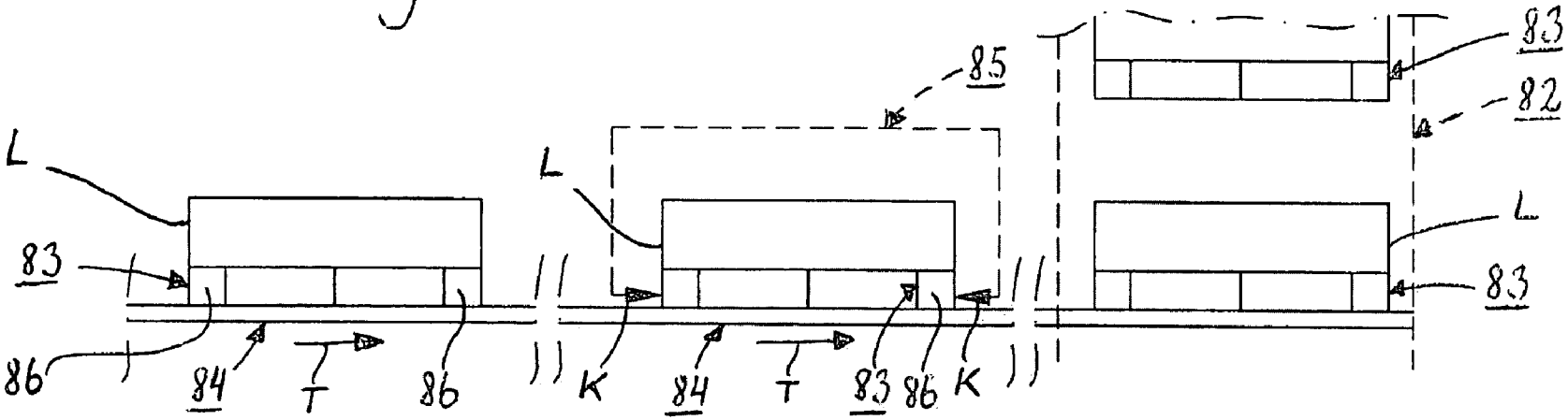
FIGS. 21 and 22 show schematically arrangements for the control and storage of loading pallets according to, among other figures, FIG. 1.
Figure 22:
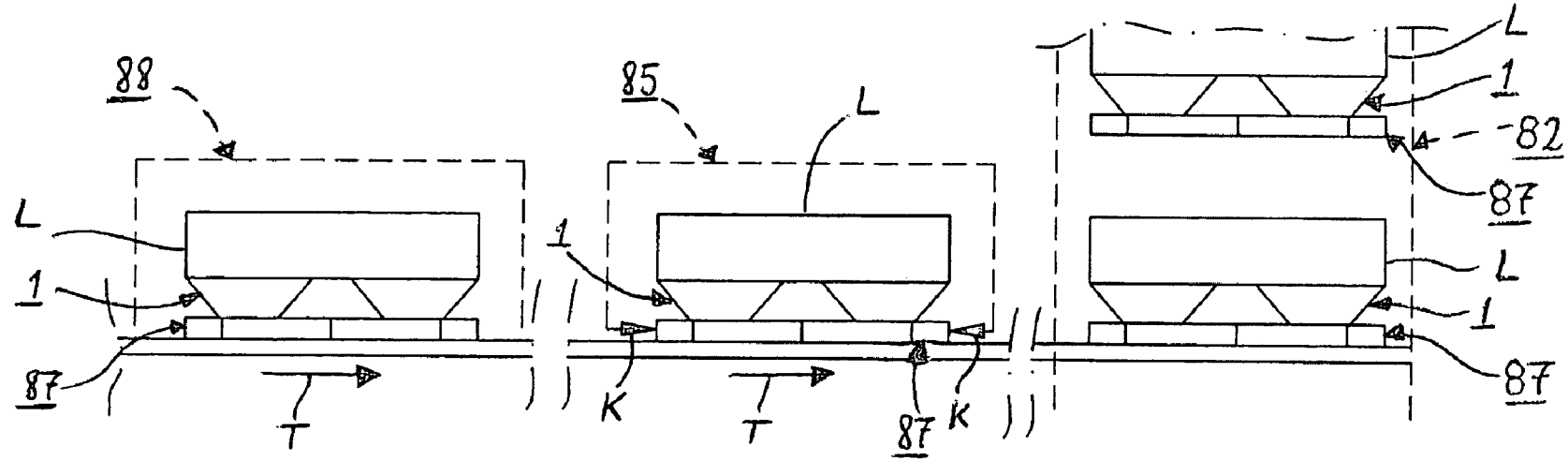

The loading pallet 1 and a load L placed onto it may be placed into a store 82 such as, for example, a store of the type known as a "high-bay" store, for loading pallets (see FIGS. 21 and 22), which may originally be intended for storage of another type of loading pallet 83. There is often a transport arrangement 84 available onto which these loading pallets 83 are placed, and which is displaced in a direction T towards the store 82 in order to transport the loading pallets 83 into this store. The loading pallets 83 may be caused to pass a control arrangement 85 during their transport in the direction T towards the store, which control arrangement is intended to check, using suitable means, that the lower part or other important parts 86 of the loading pallet 83 has or have a pre-determined size or sizes, and possibly also a pre-determined shape or shapes. The control signals of the control arrangement 85 are shown in the drawing by arrows K. If the control arrangement 85 determines that the size and possibly also the shape of the said parts 86 do not agree with the pre-determined values, this may stimulate the emission of an alarm signal, it may stop the transport arrangement 84, or both.

In order to achieve the control arrangement allowing the placement of loading pallets 1, i.e. loading pallets of a type other than that of the loading pallets 83, into the store 82, pallet support units 87 may be used that have the same size and possibly also the same shape as those that the said lower parts 86 of the loading pallet 83 have. The loading pallets 1 can be placed onto the pallet support units 87 in an exchange station 88 and these can be checked by the control arrangement 85 with their loading pallet 1 placed on top. The control arrangement 85 will then register that the size and possibly also the shape in question of the pallet support units 87 agree with the equivalent size and possibly also shape of the loading pallets 83 and will in this way accept the passage of the pallet support units 87 with their loading pallets 1 without stimulating the emission of an alarm signal, and thus the pallet support units 87 with their loading pallets 1 can be placed into the store 82. The control arrangement 85 will thus arrive at the same result during the said checking operation independently of whether it checks the size of the said parts 86 of the loading pallets 83 or those of the pallet support units 87, and both types of loading pallet 1 and 83 can be placed into the same store 82.

The said loading pallet 83 of another type, which was the type originally intended to be stored in the store 82, may be a wooden pallet, and corner blocks or the equivalent may be components of the lower parts 86.

The invention claimed is:

1. A loading pallet comprising:

at least first, second and third bars (2, 3 and 4), the first bars (2) and the second bars (3) are arranged essentially parallel with each other, the first bars (2) include portions arranged essentially in a single plane (8), the second bars (3) include portions of upper parts (9) arranged essentially in the plane (8) and downwardly directed parts (10) directed downwards relative to the plane (8), the third bars (4) extend transverse relative to the first bars (2) and second bars (3), lie under the plane (8), and are connected to the first bars (2) and the upper parts (9) of the second bars (3), the loading pallet (1) is stacked onto a corresponding loading pallet (1) that is located below such that the downwardly directed parts (10) of one loading pallet (1) protrude downwards into upwardly open spaces (14) formed by the downwardly directed parts (10) of the loading pallet (1) that is located below, the third bars (4) are arranged on the loading pallet (1) such that when the loading pallet (1) is stacked onto the loading pallet (1) that is located below, the third bars (4) make contact with the first bars (2) in the plane (8) from the loading pallet (1) that is located below, and the height (h5) of the third bars (4) is such that the height of spaces (22) between stacked loading pallets (1) allows lifting means (17) for lifting loading pallets (1) to be introduced into the spaces (22).

2. The loading pallet according to claim 1, wherein the downwardly directed parts (10) form spaces (14 or 20) into which lifting means (17) are introduced and which help to define the spaces (22) between different loading pallets (1) stacked on top of each other.

3. The loading pallet according to claim 1, wherein:

two downwardly directed parts (10) form two spaces (14 or 20) that help to define the spaces (22) between two loading pallets (1) stacked on top of each other, and one of two lifting means (17) is introduced into each space (14 or 20).

4. The loading pallet according to claim 2, wherein the spaces (14) formed by the downwardly directed parts (10) are arranged in the downwardly directed parts (10).

5. The loading pallet according to claim 2, wherein the spaces (20) formed by the downwardly directed parts (10) are arranged between downwardly directed parts (10) and also between two third bars (4) arranged between downwardly directed parts (10).

6. The loading pallet according to claim 1, wherein the height (h5) of the third bars (4) and the downwardly directed parts (10) are configured such that the downwardly directed parts (10) of an upper loading pallet (1) interact with upwardly open spaces (14) formed by the downwardly directed parts (10) of the loading pallet (1) that is located below the upper loading pallet (1) when the loading pallets (1) are stacked on top of each other to counteract the loading pallets (1) becoming stuck to each other by wedging when they are stacked.

7. The loading pallet according to claim 1, further comprising fourth bars (5) which include portions that lie essentially in the plane (8) of the loading pallet (1), are arranged essentially parallel with the first bars (2) and the second bars (3), and extend as side bars along opposite sides of the loading pallet (1).

8. The loading pallet according to claim 1, wherein the downwardly directed parts (10) are so arranged that, when loading pallets (1) are stacked on top of each other, lower parts (12) of the downwardly directed parts (10) of the loading pallet (1) lie essentially in the same plane as a plane (8) of a third loading pallet (1) located below the loading pallet (1) in which the first (2), second (3) and third (4) bars lie.

9. The loading pallet according to claim 1, wherein the first, second, and third bars (2, 3, 4) have a principally U-shaped cross-section with a central part (23) and legs (24, 25) that emanate from the central part (23).

10. The loading pallet according to claim 9, wherein:

at least one of the first bars (2) and the upper parts (9) of the second bars (3) are arranged with their central parts (23) lying above the plane (8) and their legs (24, 25) directed downwards, and the legs (24, 25) include flanges (26) that lie essentially in the plane (8) and connect the first bars (2) and the second bars (3) with the third bars (4).

11. The loading pallet according to claim 10, wherein the first bars (2) include upwardly directed flange parts (27) that extend upwards from the plane (8).

12. The loading pallet according to claim 9, wherein:

the third bars (4) are arranged with their central parts (23) lying at the lowest point and their legs (24, 25) directed upwards, and the legs (24, 25) include flanges (28, 29) that lie essentially in the plane (8) and connect the third bars (4) with the first bars (2) and the second bars (3).

13. The loading pallet according to claim 1, wherein the bars (2-4) include inwardly folded edge parts (30).

14. The loading pallet according to claim 1, wherein the third bars (4) are connected with the first bars (2) and the second bars (3) through hollow rivets (31).

15. The loading pallet according to claim 14, wherein the hollow rivets (31) are riveted through parts of the bars (2-4) that do not have holes.

16. The loading pallet according to claim 1, wherein the bars (2-4) include metal material.

17. The loading pallet according to claim 1, wherein each loading pallet (1) includes four first bars (2) and three second bars (3), and in that two first bars (2) are arranged between two second bars (3).

18. The loading pallet according to claim 1, wherein each second bar (3) has two downwardly directed parts (10).

19. The loading pallet according to claim 1, wherein each second bar (3) has three downwardly directed parts (10).

20. The loading pallet according to claim 1, wherein:

the downwardly directed parts (10) of the second bars (3) include lower parts (12) through which the downwardly directed parts (10) make contact with a base (13), and layers or elements (32) are arranged on the lower parts (12) to counteract the sliding of the loading pallet (1) on the base (13).

21. The loading pallet according to claim 20, the layers or elements are protective layers or protective elements (32) arranged on the lower parts (12) and including aluminum attached by riveting (31).

22. The loading pallet according to claim 1, wherein at least one third bar (4) is arranged between two downwardly directed parts (10) of the second bars (3).

23. The loading pallet according to claim 22, wherein:

each one of the two downwardly directed parts (10) of the second bars (3) has a support section (55)

that supports the third bar (4) arranged between the two downwardly directed parts (10) when the third bar is placed under load from above.

24. The loading pallet according to claim 23, further comprising fourth bars (5) which have principally a U-shape with a central part (23) and legs (24, 25) that emanate from the central part (23) and a flange (28 and 29) that emanates from each leg (24 and 25), and each flange (28 and 29) makes contact with one of the support sections (55).

25. The loading pallet according to claim 1, wherein at least one pallet collar (33) that includes metal material is placed onto the loading pallet (1).

26. The loading pallet according to claim 25, wherein the pallet collar (33) includes side walls (34-37) with gripping sections (38) that grip around the bars (2-5) of the loading pallet (1) when the pallet collar (33) is arranged on the loading pallet (1) to prevent the pallet collar (33) from sliding off the loading pallet (1).

27. The loading pallet according to claim 26, wherein the gripping sections (38) are integral with the relevant side wall (34-37).

28. The loading pallet according to claim 26, wherein the side walls (34-37) have longitudinal reinforcement ridges (39) formed by pressure from the wall material of the side walls (34-37) by rolling the wall material.

29. The loading pallet according to claim 25, wherein the side walls (34-37) of the pallet collar (33) are connected by joints with each other through hinges (40).

30. The loading pallet according to claim 29, wherein the hinge (40) is formed by tabs (41, 43) from neighboring side walls (34-37) of the pallet collar (33), the tabs (41, 43) forming tube-shaped parts that grip a shaft (45) to allow rotation between the tabs (41, 43) and the shaft (45).

31. The loading pallet according to claim 25, wherein a cover (46) that includes metal material is placed onto the pallet collar (33).

32. The loading pallet according to claim 31, wherein the cover (46) includes edges (47) that extend out over the side walls (34-37) of a pallet collar (33) onto which the cover (46) is placed to prevent water and objects from penetrating a loading space (48) inside the pallet collar (33).

33. The loading pallet according to claim 31, wherein the cover (46) allows another loading pallet (1) to be placed on top of it.

34. The loading pallet according to claim 33, wherein the cover (46) includes slide preventers (49) to prevent the sliding off of a loading pallet (1) placed onto it.

35. The loading pallet according to claim 34, wherein the slide preventers (49) include three upwardly directed parts (50-52) that form a channel (53) into which downwardly directed parts (10) of a loading pallet (1) placed on the cover (46) extend.

36. The loading pallet according to claim 35, wherein at least one (52) of the upwardly directed parts (50-52) includes a hole (54) into which fingers are placed in order to grip and lift the cover (46).

37. The loading pallet according to claim 30, wherein the cover (46) is placed onto a loading pallet (1) to close a space (48) in a pallet collar (33) placed onto the loading pallet (1).

38. A loading pallet according to claim 1, wherein:

a pallet collar (33) placed onto the loading pallet (1) is at least one of folded down, folded together, and folded away such that its minimum height (h7) is significantly smaller than its maximum height (h6).

39. The loading pallet according to claim 38, wherein the pallet collar (33) is at least one of folded down, folded together, and folded away when it is arranged on the loading pallet (1).

40. The loading pallet according to claim 38, wherein the pallet collar (33) is at least one of folded down, folded together, and folded away when a cover (46) is arranged on the pallet collar (33).

41. The loading pallet according to claim 38, wherein:

the pallet collar (33) includes two ends (58, 59) and two sides (62, 63), the ends (58, 59) being folded inwards relative to the sides (62, 63), and the sides (62, 63) being folded at the centre after the ends (58, 59) are folded in to place the parts of the ends (58, 59) and the sides (62, 63) in proximity to each other.

42. The loading pallet according to claim 38, wherein the pallet collar (33) includes ends and sides (66-69) of elastic material folded towards each other and laid down on the loading pallet (1) such that the pallet collar (33) achieves a minimum height (h7) that is significantly smaller than its maximum height (h6).

43. The loading pallet according to claim 42, wherein:

the walls (66-69) of the pallet collar (33) are maintained upright by four corner pillars (70) attached to the loading pallet (1), and the corner pillars (70) are removed from the loading pallet (1) or folded down relative to it.

44. The loading pallet according to claim 43, wherein a cover (46) placed on the corner pillars (70) is supported by the corner pillars such that the corner pillars (70) remain vertical.

45. The loading pallet according to claim 38, wherein:

the pallet collar (33) includes four side walls (34-37) connected to each other at the corners through joints (40) having the form of hinges that allow the side walls (34-37) to be folded together in order to reduce the height of the pallet collar (33), and the pallet collar (33) is removed from the loading pallet (1) in order to fold it together.

46. The loading pallet according to claim 45, wherein:

each joint (40) has a shaft (45) that has an essentially vertical position when the pallet collar (33) is arranged on the loading pallet (1), and parts of the loading pallet (1) include support parts (71) to provide support for the shaft (45) when the pallet collar (33) is arranged on the loading pallet (1).

47. The loading pallet according to claim 45, wherein:

each joint (40) includes a shaft (45) having a lower shaft part (72) that has a lower collar (74) and an upper shaft part (73) that has an upper collar (75), the lower shaft part (72) has a downwardly directed end peg (76) introduced into a hole (77) in one part of the loading pallet (1) and also into a hole (78) in a supporting piece (71) on the loading pallet (1), the upper shaft part (73) has a hole (79) that allows the introduction of an end peg (76) of the lower shaft part (72) into a joint located on a pallet collar (33) placed on top of another pallet collar (33), and the lower (72) and the upper (73) shaft parts are connected to each other and introduced into tabs (41, 43) on the sides of the pallet collar (33).

48. The loading pallet according to claim 46, wherein:

the lower collar (74) of the lower part (72) of the shaft contacts a lower edge of the pallet collar (33) and the upper collar (75) of the upper part (73) of the shaft contacts an upper edge of the pallet collar (33), and the shaft parts (72, 73) screw together to draw the shaft parts (72, 73) together while the lower (74) and upper (75) collars draw together different parts of the sides of the pallet collar (33).

49. The loading pallet according to claim 38, wherein:

the pallet collar (33) includes sides (66-69) that have double walls of elastic material, gas is present at a pressure greater than atmospheric in the space between the walls, or that a gas other than air is present, or both, and a control arrangement monitors at least one of the pressure of the gas in the space and changes in the composition of the gas in order to check whether the walls leak as a result of damage to the walls.

50. The loading pallet according to claim 49, wherein the elastic walls of the pallet collar (33) are laid onto the loading pallet (1).

51. The loading pallet according to claim 38, wherein at least parts of the sides of the pallet collar (33) are transparent.

52. The loading pallet according to claim 38, wherein at least a part of the sides of the pallet collar (33) includes Kevlar.

53. A loading pallet according to claim 1 further comprising at least one transponder (56) in order to either receive or transmit radio signals, or both, the transponder being located at a distance from the metal bars (2-5) of the loading pallet (1) in order to prevent the metal bars (2-5) from interfering with the radio signals to or from the transponder (56).

54. The loading pallet according to claim 53, wherein the transponder (56) is of an RFID type.

55. The loading pallet according to claim 54, wherein the transponder (56) is of an active type powered by an integral power supply.

56. The loading pallet according to claim 54, wherein the transponder (56) is of a passive type that lacks an integral power supply.

57. A loading pallet according to claim 1, wherein:

the loading pallet (1) includes a net (57) that prevents objects from falling down between gaps between the bars (2, 3, 4) and prevents objects or animals, or both, from penetrating upwards through the gaps.

58. An arrangement to allow the placement of loading pallets (1) according to claim 1 in a store (82) originally intended for the storage of loading pallets (83) of another type, whereby a control arrangement (85) determines whether the size of parts (86) of the loading pallets (83) match a predetermined value before allowing the loading pallets (83) to be placed into the store (82), wherein:

the loading pallets (1) are placed in pallet support units (87) with the same size and shape as the parts (86) of the loading pallets (83) to allow the placement of the loading pallets (1) into the store, and the control unit (85) determines either the size of the parts (86) of the loading pallets (83) or the size of equivalent parts (86) of the pallet support units (87) of the loading pallet (1).

59. The arrangement according to claim 58, wherein the pallet support units (87) includes metal material.

60. The arrangement according to claim 58, wherein the pallet support units (87) includes plastic material.

61. The arrangement according to claim 58, wherein the loading pallets (83) of another type are loading pallets of wood.

* * * * *